US009927138B2

(12) United States Patent
Wiese

(10) Patent No.: US 9,927,138 B2
(45) Date of Patent: Mar. 27, 2018

(54) SYSTEM AND METHOD FOR CONTROLLING AT LEAST ONE FAN AND A COMPRESSOR

(71) Applicant: James Wiese, Vonore, TN (US)

(72) Inventor: James Wiese, Vonore, TN (US)

( * ) Notice: Subject to any disclaimer, the term of this patent is extended or adjusted under 35 U.S.C. 154(b) by 297 days.

(21) Appl. No.: 14/942,219

(22) Filed: Nov. 16, 2015

(65) Prior Publication Data

US 2016/0069581 A1 Mar. 10, 2016

Related U.S. Application Data

(63) Continuation-in-part of application No. 12/995,581, filed as application No. PCT/US2010/045357 on Aug. 12, 2010, now Pat. No. 9,188,352, which is a continuation-in-part of application No. 12/540,080, filed on Aug. 12, 2009, now Pat. No. 8,155,797, and a continuation-in-part of application No. 12/540,067, filed on Aug. 12, 2009, now abandoned.

(51) Int. Cl.
*F24F 11/00* (2006.01)
*F24F 7/013* (2006.01)

(52) U.S. Cl.
CPC ..... *F24F 11/0012* (2013.01); *F24F 7/013* (2013.01); *F24F 11/0001* (2013.01); *F24F 11/0015* (2013.01); *F24F 2011/0016* (2013.01)

(58) Field of Classification Search
CPC ..... F24F 11/0012; F24F 11/0001; F24F 11/0015; F24F 7/013; F24F 2011/0016
See application file for complete search history.

(56) References Cited

U.S. PATENT DOCUMENTS

| | | | |
|---|---|---|---|
| 1,153,067 | A | 9/1915 | Hackney |
| 2,010,808 | A | 8/1935 | Braine |
| 2,036,851 | A | 4/1936 | Chittenden |
| 2,218,330 | A | 10/1940 | Eliason |
| 2,337,325 | A | 12/1943 | Hach et al. |
| 2,373,497 | A | 4/1945 | Paiste, Jr. |
| 2,456,391 | A | 12/1948 | Davies |
| 2,559,495 | A | 7/1951 | Calkins |

(Continued)

FOREIGN PATENT DOCUMENTS

| | | |
|---|---|---|
| JP | 59032731 | 8/1982 |
| JP | 58145836 | 8/1983 |

(Continued)

*Primary Examiner* — Nathan L Laughlin
(74) *Attorney, Agent, or Firm* — Middleton Reutlinger

(57) ABSTRACT

A system and method for controlling at least one fan and/or a compressor are described and shown. The system may comprise an electronic controller, an indoor sensor responsive to at least one characteristic of interior air, and an outdoor sensor responsive to at least one characteristic of exterior air. The electronic controller may cause at least one fan to be activated when interior air meets certain criteria relative to a set point and exterior air meets certain criteria relative to interior air. The method may comprise the steps of measuring at least one characteristic of exterior air, at least one characteristic of interior air, and activating at least one fan when the interior air meets certain criteria relative to a set point and the exterior air meets certain criteria relative to the interior air. A compressor may be selectively activated to provide air conditioning.

19 Claims, 27 Drawing Sheets

(56) References Cited

U.S. PATENT DOCUMENTS

| | | | | |
|---|---|---|---|---|
| 2,750,868 | A | 6/1956 | Mieczkowski et al. | |
| 3,120,340 | A | 2/1964 | Strumpell | |
| 3,275,224 | A | 9/1966 | Bush | |
| 3,315,587 | A | 4/1967 | Horan | |
| 3,478,817 | A | 11/1969 | Shaw | |
| 3,500,738 | A | 3/1970 | Wenig | |
| 3,570,386 | A | 3/1971 | Baumann et al. | |
| 4,865,118 | A | 9/1989 | Moland | |
| 5,000,381 | A | 3/1991 | Mueller et al. | |
| 5,065,585 | A | 11/1991 | Wylie et al. | |
| 5,135,045 | A | 8/1992 | Moon | |
| 5,190,496 | A | 3/1993 | Shih-Chin | |
| 5,637,039 | A | 6/1997 | Chiu et al. | |
| 5,660,586 | A | 8/1997 | Chiu et al. | |
| 5,660,605 | A | 8/1997 | Chan et al. | |
| 5,664,996 | A | 9/1997 | Wang et al. | |
| 5,730,651 | A | 3/1998 | Chen et al. | |
| D402,359 | S | 12/1998 | Wang et al. | |
| 5,902,183 | A | 5/1999 | D'Souza | |
| D425,978 | S | 5/2000 | Cunning | |
| 6,161,763 | A | 12/2000 | Reuter | |
| 6,202,429 | B1 * | 3/2001 | Kinkel | F24F 1/022 165/225 |
| 6,328,095 | B1 | 12/2001 | Felber et al. | |
| 6,818,035 | B2 | 11/2004 | McGahey | |
| 7,083,110 | B2 | 8/2006 | Kim et al. | |
| 7,238,105 | B2 | 7/2007 | Reinders | |
| 7,270,600 | B2 | 9/2007 | Kim | |
| 2002/0039529 | A1 | 4/2002 | Kim | |
| 2002/0124992 | A1 | 9/2002 | Rainer et al. | |
| 2006/0168972 | A1 | 8/2006 | Fry | |
| 2006/0273183 | A1 | 12/2006 | Cavanagh et al. | |
| 2007/0264927 | A1 | 11/2007 | Choi et al. | |
| 2009/0101727 | A1 | 4/2009 | Boudreau | |
| 2009/0134231 | A1 | 5/2009 | Matsui | |
| 2009/0242651 | A1 | 10/2009 | Ha et al. | |
| 2010/0211224 | A1 | 8/2010 | Keeling et al. | |
| 2010/0242507 | A1 * | 9/2010 | Meckler | F24F 3/1423 62/94 |
| 2013/0281002 | A1 | 10/2013 | Cislo | |

FOREIGN PATENT DOCUMENTS

| | | |
|---|---|---|
| JP | 1239335 | 9/1989 |
| JP | 4295531 | 10/1992 |

* cited by examiner

SYSTEM AND METHOD FOR CONTROLLING AT LEAST ONE FAN AND A COMPRESSOR

BACKGROUND

1. Field

This invention relates to a control system and method of controlling at least one fan and a compressor.

2. Description of Related Art

Prior art window fans are utilized to move stagnant air and cool internal building areas or rooms when air conditioning is not available. There are various known problems however, with prior art fan structures. First, as depicted in FIG. 15, prior art fans in many cases only pull air into a room and fail to exhaust air which causes poor circulation within the room and therefore hinders cooling. Alternatively, other fan systems pull air into a room and exhaust air in the same vertical plane or elevation. Therefore these fan systems fail to eliminate temperature stratification and reduce cooling effectiveness.

Another problem related to prior art fans is that fan units do no inhibit water passing through a housing and into a room when the fan is operated while a rain event is occurring. Consequently, during rain events, many window fans may not be operated without drawing water into the building.

Another problem with prior art window units is the limited control of fan operation and failure to be intelligently integrated with AC functionality. Most prior art units are manually operated, meaning a user must turn the fan on and off as desired. It would be desirable to use a window fan when specific outside air criteria are met, so that the air conditioning system in the building or home is not needed when the outside air is cool and of a saturation or humidity level which would be comfortable to an occupant of the building or room.

Additionally, the use of the dew point and humidity controls would allow for increased comfort and energy savings by limiting the use of air conditioning in the building or home. Such limited use of natural resources is desirable.

It would be desirable to create a window fan unit or other fan unit, and/or a control system and/or method, which overcomes these and/or other deficiencies in order to decrease energy consumption, more efficiently cool interior areas of a building, commercial, residential or other, and improve occupant comfort while ultimately saving money on cooling by using outside air where applicable.

SUMMARY

Generally, in one aspect a control system is provided that includes an electronic controller in communication with one or more fans and with a compressor. At least one fan of the fans selectively draws air from an exterior area having exterior air into an interior area having interior air and the compressor helps selectively cool air circulated by at least one of the fans.

The control system further includes a control interface having a user selectable non-AC set point input and a separate user selectable AC set point input. The control interface is in communication with the electronic controller and provides a user selected non-AC set point and a user selected AC set point to the controller. The user selected AC set point indicates a higher dry bulb temperature than the user selected non-AC set point, and the user selected non-AC set point is based on user interaction with the non-AC set point input and the user selected AC set point is based on user interaction with the AC set point input.

The control system further includes an indoor sensor located to be responsive to at least two characteristics of the interior air and an outdoor sensor located to be responsive to at least two characteristics of the exterior air. The indoor sensor is in communication with the electronic controller and communicates, to the electronic controller, indoor air data that is indicative of the two characteristics of the interior air. The outdoor sensor is located to be responsive to at least two characteristics of the exterior air and communicates, to the electronic controller, exterior air data indicative of the two characteristics of the exterior;

The electronic controller is operable in at least a first mode. In the first mode the electronic controller causes, in conjunction with the compressor being inactive, the intake fan to be activated and exterior air to be communicated from the exterior area into the interior area when: the interior air data indicates a dry bulb temperature of the interior air is greater than the non-AC set point, the exterior air data indicates a dry bulb temperature of the exterior air is less than the dry bulb temperature of the interior air, and the exterior air data indicates a dew point of the exterior air is less than a dew point of the interior air. In the first mode the electronic controller further causes the compressor to be active and cool the interior air circulated by at least one of the fans when the interior air data indicates a dry bulb temperature of the interior air is greater than the AC set point and at least one of the following two conditions is met: the exterior air data indicates a dry bulb temperature of the exterior air is greater than the dry bulb temperature of the interior air indicated by the interior air data, and the exterior air data indicates a dew point of the exterior air is greater than a dew point of the interior air indicated by the interior air data.

In some embodiments, in the first mode the compressor is only active when the interior air data indicates the dry bulb temperature of the interior air is greater than the AC set point and at least one of the following two conditions is met: the exterior air data indicates a dry bulb temperature of the exterior air is greater than the dry bulb temperature of the interior air indicated by the interior air data, and the exterior air data indicates a dew point of the exterior air is greater than a dew point of the interior air indicated by the interior air data.

In some embodiments, in the first mode the electronic controller causes the intake fan to be activated and the compressor to be activated to cool exterior air pulled in by the intake fan when: the interior air data indicates a dry bulb temperature of the interior air is greater than the AC set point, the exterior air data indicates a dry bulb temperature of the exterior air is less than the dry bulb temperature of the interior air, and the exterior air data indicates a dew point of the exterior air is less than a dew point of the interior air.

Generally, in another aspect a method is provided that includes: receiving, in response to user interaction with a control interface, a user selected non-AC set point and a user selected AC set point, the user selected AC set point indicating a higher dry bulb temperature than the user selected non-AC set point input; receiving, from an indoor sensor, indoor sensor data that is indicative of at least two characteristics of interior air of an interior area; and receiving outdoor sensor data that is indicative of at least two characteristics of exterior air of an exterior area.

The method further includes determining satisfaction of a first set of conditions, and in response to determining the satisfaction of the first set of conditions, activating a fan to draw exterior air into the interior area without activating a compressor. The first set of conditions include: that the interior air data indicates a dry bulb temperature of the interior air is greater than the non-AC set point, that the exterior air data indicates a dry bulb temperature of the exterior air is less than the dry bulb temperature of the interior air, and that the exterior air data indicates a dew point of the exterior air is less than a dew point of the interior air.

The method further includes determining satisfaction of a second set of conditions, and in response to determining the satisfaction of the second set of conditions, activating the compressor to cool the interior air as it is circulated over an evaporator coil coupled to the compressor. The second set of conditions include: that the interior air data indicates a dry bulb temperature of the interior air is greater than the AC set point, and at least one of: that the exterior air data indicates a dry bulb temperature of the exterior air is greater than the dry bulb temperature of the interior air indicated by the interior air data, and that the exterior air data indicates a dew point of the exterior air is greater than a dew point of the interior air indicated by the interior air data.

In some embodiments the method further includes determining satisfaction of a third set of conditions, and in response to determining the satisfaction of the third set of conditions, activating the fan and/or an additional fan to draw the exterior air into the interior area and activating the compressor to cool the exterior air as it is circulated over the evaporator coil coupled to the compressor. The third set of conditions include: that the interior air data indicates a dry bulb temperature of the interior air is greater than the AC set point, that the exterior air data indicates a dry bulb temperature of the exterior air is less than the dry bulb temperature of the interior air, and that the exterior air data indicates a dew point of the exterior air is less than a dew point of the interior air.

Generally, in another aspect a method is provided that includes: receiving, in response to user interaction with a control interface, a user selected non-AC set point and a user selected AC set point, the user selected AC set point indicating a higher dry bulb temperature than the user selected non-AC set point input; receiving, from an indoor sensor, indoor sensor data that is indicative of at least two characteristics of interior air of an interior area; and receiving outdoor sensor data that is indicative of at least two characteristics of exterior air of an exterior area.

The method further includes determining satisfaction of a first set of conditions, and in response to determining the satisfaction of the first set of conditions, ensuring a barrier is open and activating a fan to draw exterior air into the interior area via an opening caused by the barrier being open without activating a compressor. The first set of conditions include: that the interior air data indicates a dry bulb temperature of the interior air is greater than the non-AC set point, but less than the AC set point, that the exterior air data indicates a dry bulb temperature of the exterior air is less than the dry bulb temperature of the interior air, and that the exterior air data indicates a dew point of the exterior air is less than a dew point of the interior air.

The method further includes determining satisfaction of a second set of conditions, and in response to determining the satisfaction of the second set of conditions, ensuring the barrier is closed and activating the compressor to cool the interior air as it is circulated over an evaporator coil coupled to the compressor. The second set of conditions include: that the interior air data indicates a dry bulb temperature of the interior air is greater than the AC set point, and at least one of: that the exterior air data indicates a dry bulb temperature of the exterior air is greater than the dry bulb temperature of the interior air indicated by the interior air data, and that the exterior air data indicates a dew point of the exterior air is greater than a dew point of the interior air indicated by the interior air data.

The method further includes determining satisfaction of a third set of conditions, and in response to determining the satisfaction of the third set of conditions, ensuring the barrier is open and activating the fan to draw the exterior air into the interior area and activating the compressor to cool the exterior air as it is circulated over the evaporator coil coupled to the compressor. The third set of conditions include: that the interior air data indicates a dry bulb temperature of the interior air is greater than the AC set point, that the exterior air data indicates a dry bulb temperature of the exterior air is less than the dry bulb temperature of the interior air, and that the exterior air data indicates a dew point of the exterior air is less than a dew point of the interior air.

Generally, in another aspect a control system for a fan unit is provided. The fan unit has a fan for selectively drawing air from an exterior area having exterior air into an interior area having interior air. The control system includes an electronic controller in electrical communication with the fan and a control panel having a user selectable set point input. The set point input is in electrical communication with the electronic controller and provides a user selected set point to the electronic controller. The control system also includes an indoor sensor and an outdoor sensor each in electrical communication with the electronic controller. The indoor sensor is located so as to be responsive to at least one characteristic of the interior air and communicates the at least one characteristic of the interior air to the electronic controller. The outdoor sensor is located so as to be responsive to at least one characteristic of the exterior air and communicates the at least one characteristic of the exterior air to the electronic controller. The fan unit is operable in an automatic mode and in the automatic mode the electronic controller causes the fan to be activated and exterior air to be communicated between the exterior area and the interior area when: the at least one characteristic of the interior air indicates a dry bulb temperature of the interior air is greater than the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air.

In some embodiments the control system includes a second fan that is an exhaust fan that selectively expels the interior air into the exterior area. In versions of these embodiments the fan may be driven at a plurality of speeds. In versions of these embodiments the speed of the fan may correspond to a differential between the set point and the indoor dry bulb temperature and/or the speed of the second fan may correspond to a differential between the set point and the indoor dry bulb temperature. In versions of these embodiments the second fan is disposed vertically above the fan when the fan unit is installed.

In some embodiments the control system further includes a selectively activated compressor in communication with the electronic controller. The compressor helps selectively cool interior air circulated by the fan unit back into the interior area. In those embodiments the electronic controller causes the compressor to be inactive when: the at least one characteristic of the interior air indicates a dry bulb temperature of the interior air is above the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air. In versions of these embodiments the electronic controller causes the compressor to be active when: the at least one characteristic of the interior air indicates a dry bulb temperature of the interior air is above the set point, and at least one of the following two conditions is met: (1) the at least one characteristic of the exterior air indicates a dry bulb temperature of the exterior air is greater than the dry bulb temperature of the interior air; and (2) the at least one characteristic of the exterior air indicates a dew point of the exterior air is greater than a dew point of the interior air as indicated by the at least one characteristic of the interior air. In versions of these embodiments the electronic controller closes at least one barrier when the compressor is activated, thereby substantially isolating the fan from the exterior air. When the barrier is closed and the compressor is activated the fan circulates the interior air over an evaporator coil and back into the interior area. In versions of these embodiments the control system further includes a second fan. When the at least one barrier is closed and the compressor is activated the second fan selectively circulates the exterior air over a condensing coil and into the exterior area. In versions of these embodiments the second fan selectively expels the interior air into the exterior area when: the at least one characteristic of the interior air indicates a dry bulb temperature of the interior air is greater than the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air. In versions of these embodiments the electronic controller causes the compressor to be active when: the at least one characteristic of the interior air indicates a dry bulb temperature of the interior air is above an AC set point, the AC set point being greater than the set point, and at least one of the following two conditions is met: (1) the at least one characteristic of the exterior air indicates a dry bulb temperature of the exterior air is greater than the dry bulb temperature of the interior air; and (2) the at least one characteristic of the exterior air indicates a dew point of the exterior air is greater than a dew point of the interior air as indicated by the at least one characteristic of the interior air.

Generally, in another aspect a method of controlling a fan unit is provided. The fan unit has an intake fan that selectively draws exterior air through the fan unit into a building interior and at least one barrier that selectively inhibits airflow through the fan unit. The method includes the steps of: allowing a user to select a set point indicative of a minimum desired temperature of interior air; measuring at least one characteristic of the exterior air; measuring at least one characteristic of the interior air; activating the intake fan and opening the at least one barrier to allow exterior air through the fan unit and into the interior area when: the at least one characteristic of the interior air indicates a dry bulb temperature of the interior air is above the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air.

In some embodiments the fan unit includes an exhaust fan that selectively expels interior air through the fan unit into an exterior and the method further includes the step of activating the exhaust fan when: the at least one characteristic of the interior air indicates a dry bulb temperature of the interior air is above the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air. In versions of these embodiments the intake fan and the exhaust fan are each drivable at a plurality of speeds. In versions of these embodiments the method further includes the step of deactivating the intake fan, deactivating the exhaust fan, and closing the at least one barrier when the at least one characteristic of the interior air indicate a dry bulb temperature of the interior air is less than the set point.

In some embodiments the fan unit has air conditioning functionality and includes a selectively activated compressor. In versions of these embodiments the method further includes the step of causing the compressor to be inactive when: the at least one characteristic of the interior air indicates a dry bulb temperature of the interior air is above the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air. In versions of these embodiments the method further includes the step of causing the compressor to be active when: the at least one characteristic of the interior air indicates a dry bulb temperature of the interior air is above the set point, and at least one of the following two conditions is met: (1) the at least one characteristic of the exterior air indicates a dry bulb temperature of the exterior air is greater than the dry bulb temperature of the interior air; and (2) the at least one characteristic of the exterior air indicates a dew point of the exterior air is greater than a dew point of the interior air as indicated by the at least one characteristic of the interior air. In versions of these embodiments the fan unit includes a second fan and when the compressor is activated the second fan selectively circulates the exterior air over a condensing coil and into the exterior area. In versions of these embodiments the second fan selectively expels the interior air into the exterior area when: the at least one characteristic of the interior air indicates a dry bulb temperature of the interior air is greater than the set point, the at least one characteristic of the exterior air indicates a dry bulb temperature of the exterior air is less than the dry bulb temperature of the interior air, and the at least one characteristic of the exterior air indicates a dew point of the exterior air is less than a dew point of the interior air as indicated by the at least one characteristic of the interior air. In versions of these embodiments the electronic controller may cause the compressor to be active when the at least one characteristic of the interior air indicates a dry bulb temperature of the interior air is above an AC set point, the AC set point being greater than the set point, and at least one of the following two conditions is met: (1) the at least one characteristic of the exterior air indicates a dry bulb temperature of the exterior air is greater than the dry bulb temperature of the interior air; and (2) the at least one characteristic of the exterior air indicates a dew point of the exterior air is greater than a dew point of the interior air as indicated by the at least one characteristic of the interior air.

In the control system and in the method the at least one characteristic of the interior air may include an interior relative humidity measurement and the at least one characteristic of the exterior air may include an exterior relative humidity measurement. The at least one characteristic of the interior air may include an interior dry bulb temperature measurement and the at least one characteristic of the exterior air may include an exterior dry bulb temperature measurement; an interior dew point may be calculated from the interior dry bulb temperature measurement and the interior relative humidity measurement; an exterior dew point may be calculated from the exterior dry bulb temperature measurement and the exterior relative humidity measurement; and the interior dew point may be compared to the exterior dew point to thereby determine if the dew point of the exterior air is less than the dew point of the interior air. The at least one characteristic of the interior air may include an interior dry bulb temperature measurement and the at least one characteristic of the exterior air may include an exterior dry bulb temperature measurement; an interior specific humidity level may be calculated from the interior dry bulb temperature measurement and the interior relative humidity measurement; an exterior specific humidity level may be calculated from the exterior dry bulb temperature measurement and the exterior relative humidity measurement; and the exterior specific humidity level may be compared to the specific humidity level to thereby indirectly determine if the dew point of the exterior air is less than the dew point of the interior air.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
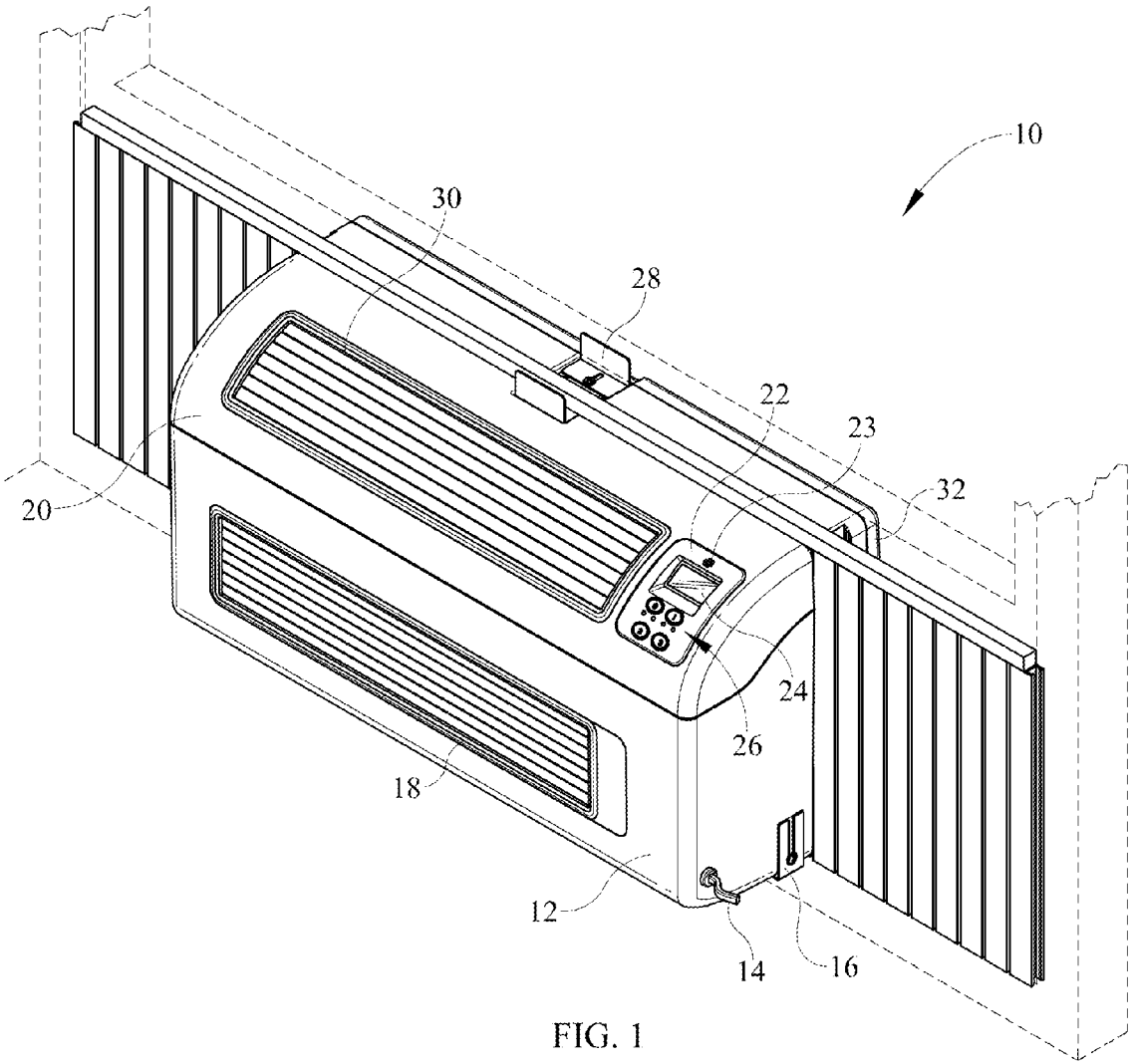
FIG. 1 is a perspective view of a window fan system positioned in a window sill for use.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now to the drawings wherein like numerals indicate like elements throughout the several views that are shown in FIGS. 1-25 various aspects of a fan system or fan unit. The fan system may inhibit rain passage through the housing and dispels the rain without the water content entering the interior area of the building. The fan unit may also comprises a barrier or louver system to, among other things, open and close vents to limit heat transfer through the system when the fans are turned off. Additionally, the fan unit may have a ducting arrangement which pulls air into a room and exhausts air from the room to improve circulation and may utilize a fan arrangement to aid with the circulation. The fan system also utilizes a control system to selectively utilize outside air having desirable characteristics which cools the room and may be also used with existing air conditioning, therefore decreasing the reliance on an air conditioning system, and saving energy and costs associated with air conditioning operation. The fan system may also optionally incorporate selective air conditioning functionality.

Referring now to FIG. 1, a perspective view of a window fan system 10 is depicted on a window sill and with a window sash (both shown in broken line) engaging an upper surface of the window fan system 10. Positioned about the lower portion of the fan system 10 is a lower housing 12 which wraps around the front and sides of the fan system 10 and may be formed of metal, plastic or other resilient material and which has aesthetically pleasing qualities. A power cord 14 is shown extending from a side of the lower housing 12 and may extend to a power supply such as an in-wall power outlet (not shown). Adjacent to power cord 14 is a sill bracket 16 which allows for adjustable connection to the window sill wherein the window fan system 10 is positioned. Although a sash type window is depicted, it should be understood that use of the window fan system 10 may be used with slider type window which slides in a horizontal direction rather than a vertical direction.

Within the lower housing 12 is an outside air exhaust 18. When outside air is entrained into the fan system 10 and passes through at least one fan within the window fan system 10, the outside air is exhausted into the building or room through the outside air exhaust 18. The outside air exhaust 18 is positioned on the lower area of the housing so that an upper intake 30 can remove hotter air from the room. The outside air exhaust 18 may be opened or closed to allow or inhibit airflow into the room or area being cooled.

Above the lower housing 12 is an upper housing 20 which may also be formed of metal, plastic or other resilient material like the lower housing 12 and may be matching. The upper and lower housings 20, 12 of the exemplary embodiment are depicted as separate housing pieces, however, such housing elements 12, 20 may be combined into a single one-piece housing. Additionally, the upper housing 20 comprises a control panel 22 having a display 24 and at least one control button 26. Adjacent to the control panel 22 is a room exhaust intake 30. The window fan system 10 also exhausts air from inside the building to outside in order to improve circulation within the room or building. Thus, cooler air comes into the building through the outside air exhaust 18 and hotter air is withdrawn from the room through the upper room exhaust intake 30. With the room exhaust intake 30 on the upper surface of the window fan system 10, the room exhaust intake 30 can better draw warm air from the room and move it outside. Conversely, the outside air exhaust 18 is at a lower position, as this air is cooler than the warmer air being exhausted by the room exhaust intake 30. This configuration aids circulation since warm air rises and cooler air descends.

The surrounding window structure is shown in broken line to provide environmental understanding of how the window fan system 10 is placed in the window and when the sash is closed against the upper surface of the upper housing 20. Positioned on the upper housing 20 is an adjustable sash bracket 28. This bracket provides an adjustable width to fit various sizes of window sash. The bracket 28 also provides adjustability to compensate for the position the window fan 10 is inwardly or outwardly relative to the window sill beneath the system 10. For example, some windows will require further positioning of the system 10 toward the interior of the building than other windows. The sash bracket 28 also aids to compensate for such adjustments.

Figure 2:
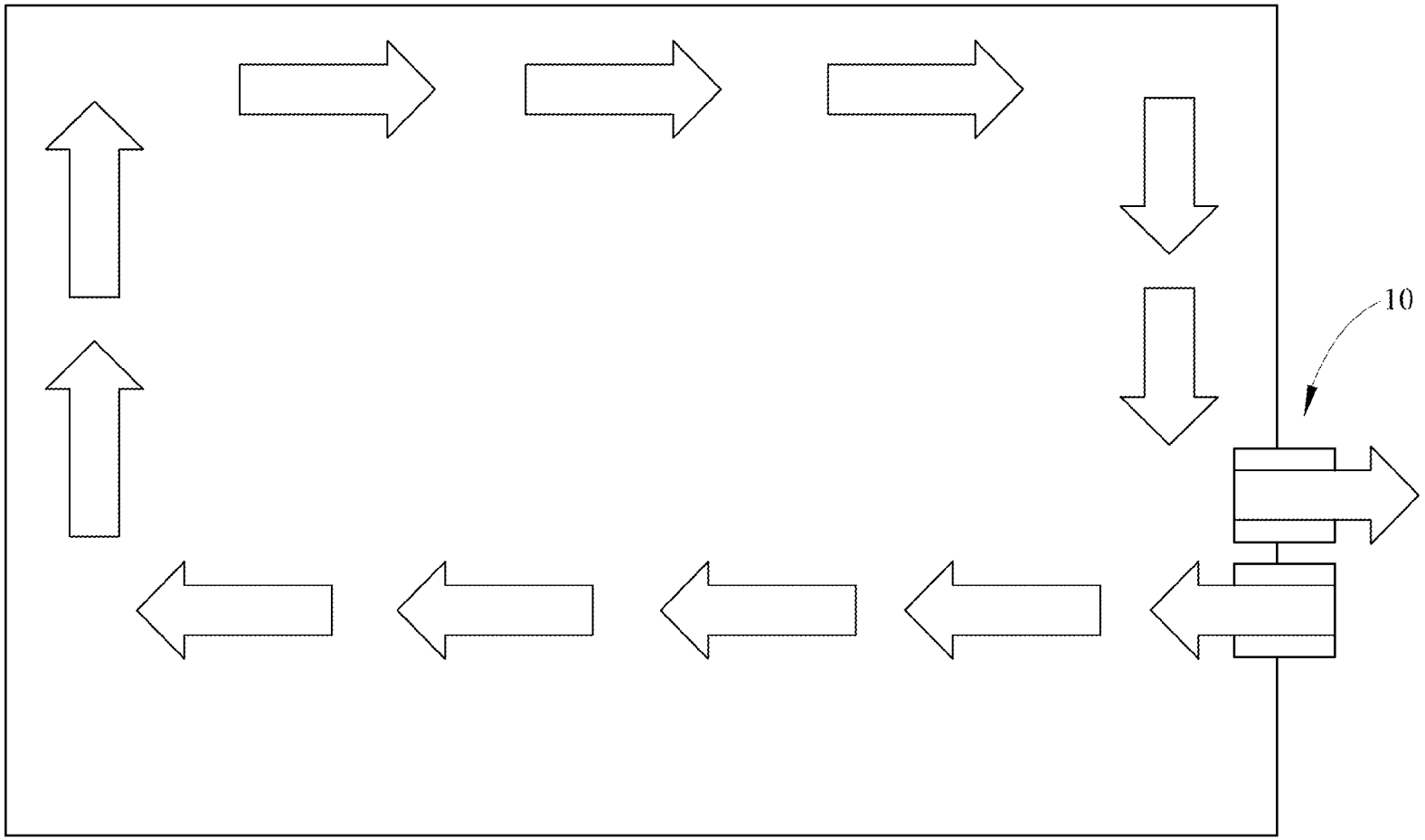
FIG. 2 is a side schematic view of a room circulation pattern showing both intake into and exhaust from the room.

Referring now to FIG. 2, a side schematic view of a room is depicted. A window fan system 10 is depicted in a sidewall of the room. A lower fan draws air into the room which circulates across the room, up an opposite wall, along the ceiling and down the wall in which the window fan unit 10 is positioned. Additionally, it will be understood that the air moving into the room may move along the walls toward the window fan system 10. As the air moves along the walls toward the system 10, any rising temperature of the air will cause the air to rise nearer the fan system 10. A second upper fan draws air from within the room and out to atmosphere. As previously indicated, the upper fan is utilized to draw air from the room since warmer air will be higher in the room. In comparison with FIG. 15, one of skill in the art will recognize that where the prior art device fails by not removing air from the interior, the instant embodiment removes warmer air increasing circulation, which ultimately aids in cooling the room. The vertical circulation pattern created by the fan system 10 eliminates temperature stratification of prior art devices with air intake and air exhaust both in the same vertical elevation Referring now to FIG. 3, a rear perspective view of the window fan system 10 is depicted. The rear side of the window fan system 10 is positioned on the outside of the building being cooled both drawing air into the room and exhausting air out of the room. With the upper housing 20, the lower housing 12 and the rear louver 32 all removed, a frame 40 is revealed. The frame 40 comprises a first side member 41 and a second opposed side member 43. Both the first side member 41 and the second side member 43 are vertical members and substantially parallel to one another in the exemplary embodiment although such design should not be considered limiting. Along the upper side of the frame 40 and connecting the first side member and second side member 41,43 is an upper frame member 42. The upper frame member 42 is substantially horizontal and opposite to an opening 44 which is defined by a first strut 45 and an opposed second strut 46. Around the mid-portion of the frame 40, in a vertical direction is a partition 38 which separates the upper exhaust portion 50 from the lower intake portion 52 of the window fan system 10. On the upper side of the fan partition 38, is an upper fan housing 54. Beneath the partition 38 in the lower intake portion 52 is a lower fan housing 56. Each of the housings 54, 56 may be formed of one or more housing portions which are connected in various manners or alternatively may be formed integrally.

Figure 3:
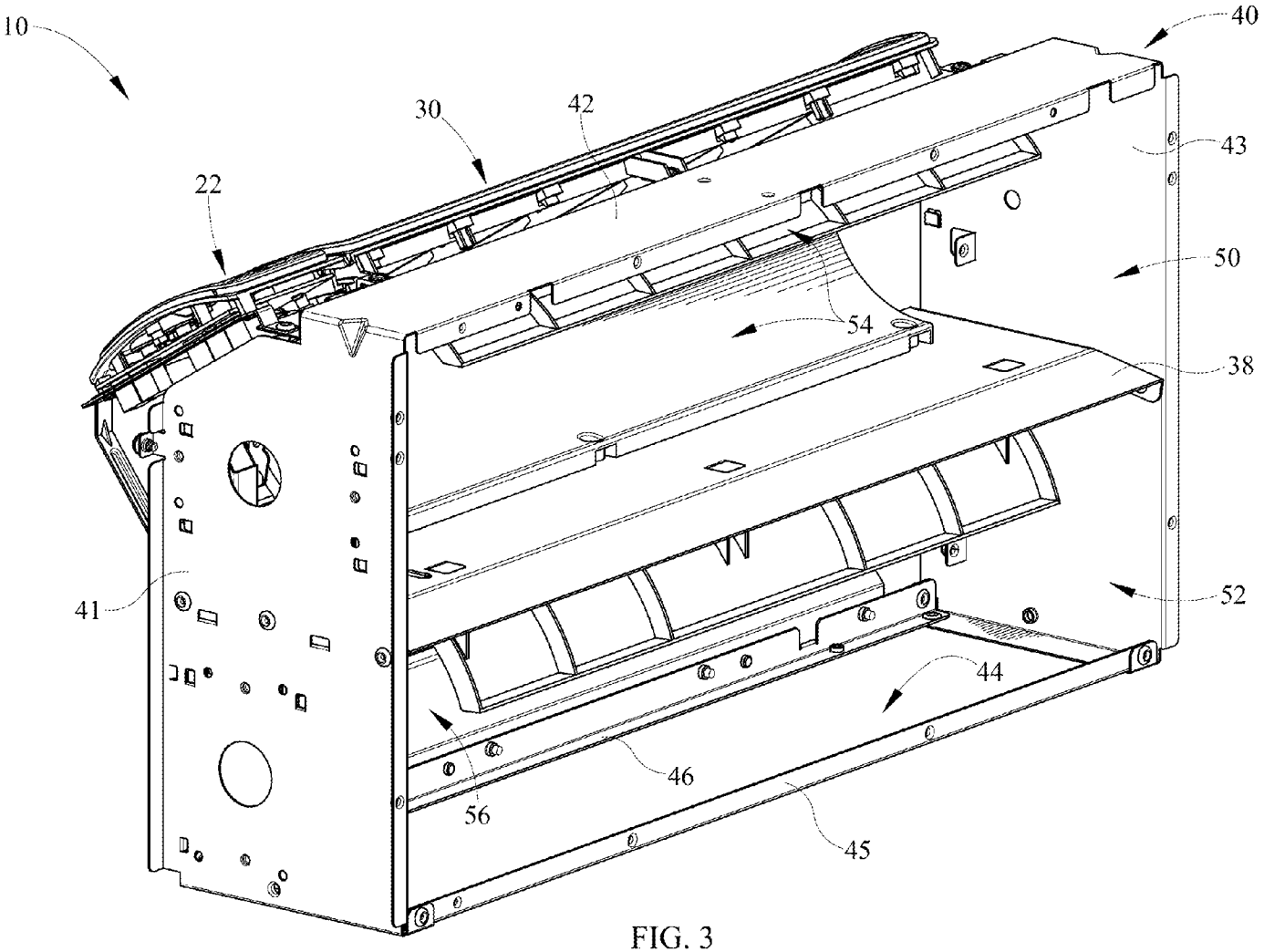
FIG. 3 is a rear perspective view of the window fan system with the housing structure removed.
Figure 4:
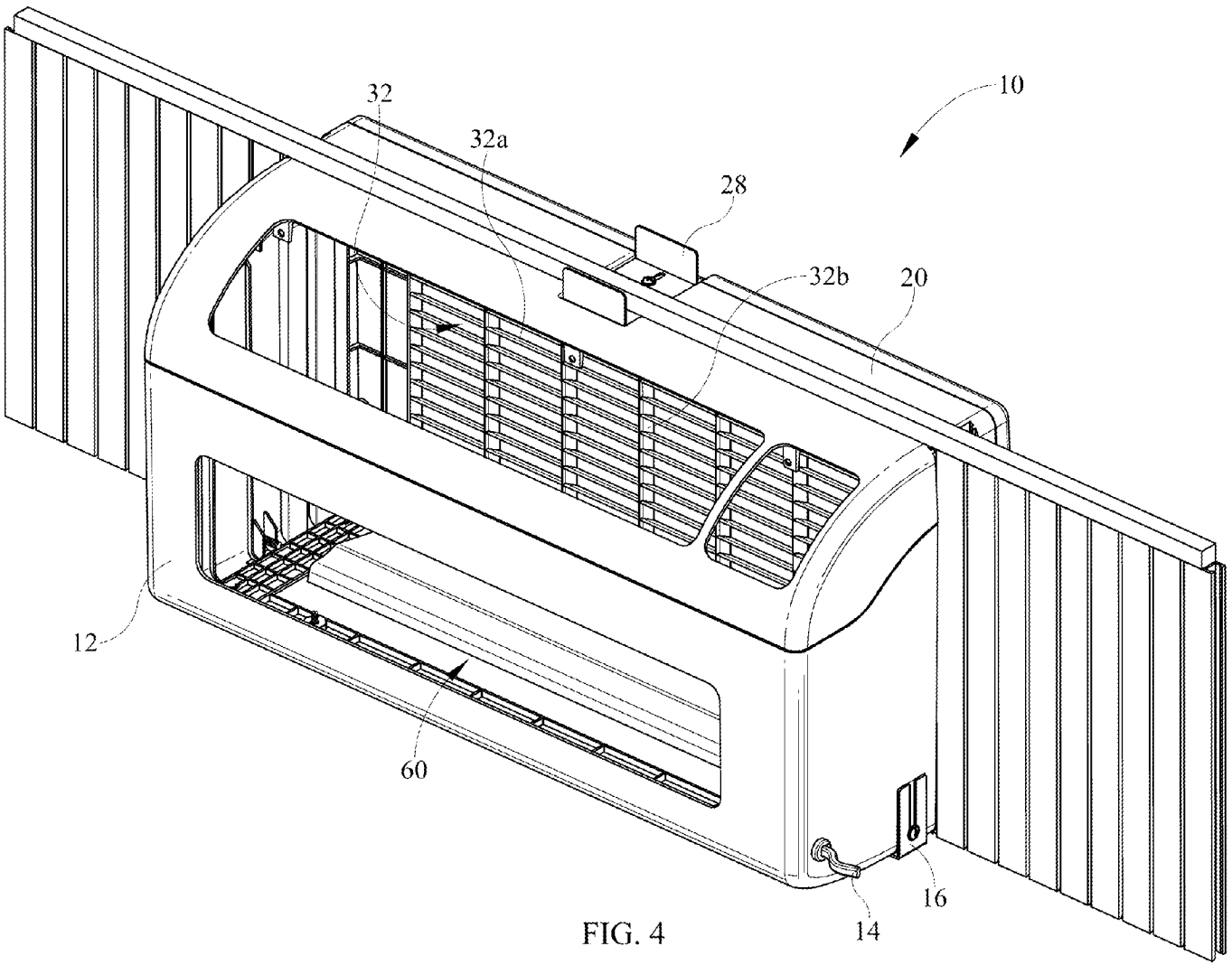
FIG. 4 is a perspective view of the housing of the window fan system with much of the internal structure removed.

Referring now to FIG. 4, a perspective view of a window fan system 10 is depicted with the internal components of the system 10 removed. Through the openings of the upper housing 20, the rear louver 32 may be seen which is positioned on the outwardly facing side of the window fan system 10. The rear louver 32 covers the upper exhaust portion 50 and the lower intake portion 52 (FIG. 3). These portions 50,52 are separated by the partition 38 (FIG. 2) so as to create two separate air pathways. The lower intake portion 52 pulls outside air into the system 10 directs the air into the building or home through the outside air exhaust 18. The upper exhaust portion 50 pulls air from the room or building interior through the room exhaust intake 30 and directs this warmer air out of the upper half of the rear louver 32.

Within the lower area of the system 10, a dam 60 may be seen adjacent the rear louver 32. The dam 60 is located generally between the first and second struts 45, 46 (FIG. 2). The dam 60 may be separately formed and positioned between the struts 45,46 or, alternatively the dam 60 may be integrally formed with lower housing portion 12, frame 40, or other portions of the fan system 10. In either formation, the dam 60 inhibits water passage through the fan system 10. Water passing through the lower portion of rear louver 32 encounters the dam 60 as it moves into or toward the lower intake portion 52. The dam inhibits the water droplet from passing though the housing and into the room. The dam 60 performs this function by creating a reservoir for water droplets which fall out of the airstream being pulled into the housing. In other words, the dam 60 effectuates removal from the entrained water droplets from the airflow. Afterward, the fallen water droplets are gravity fed to a well 62 (FIG. 6) where the water may drain through the housing and out of the system 10 and may be aided by the lower fan at the bottom of the fan blade.

Figure 5:
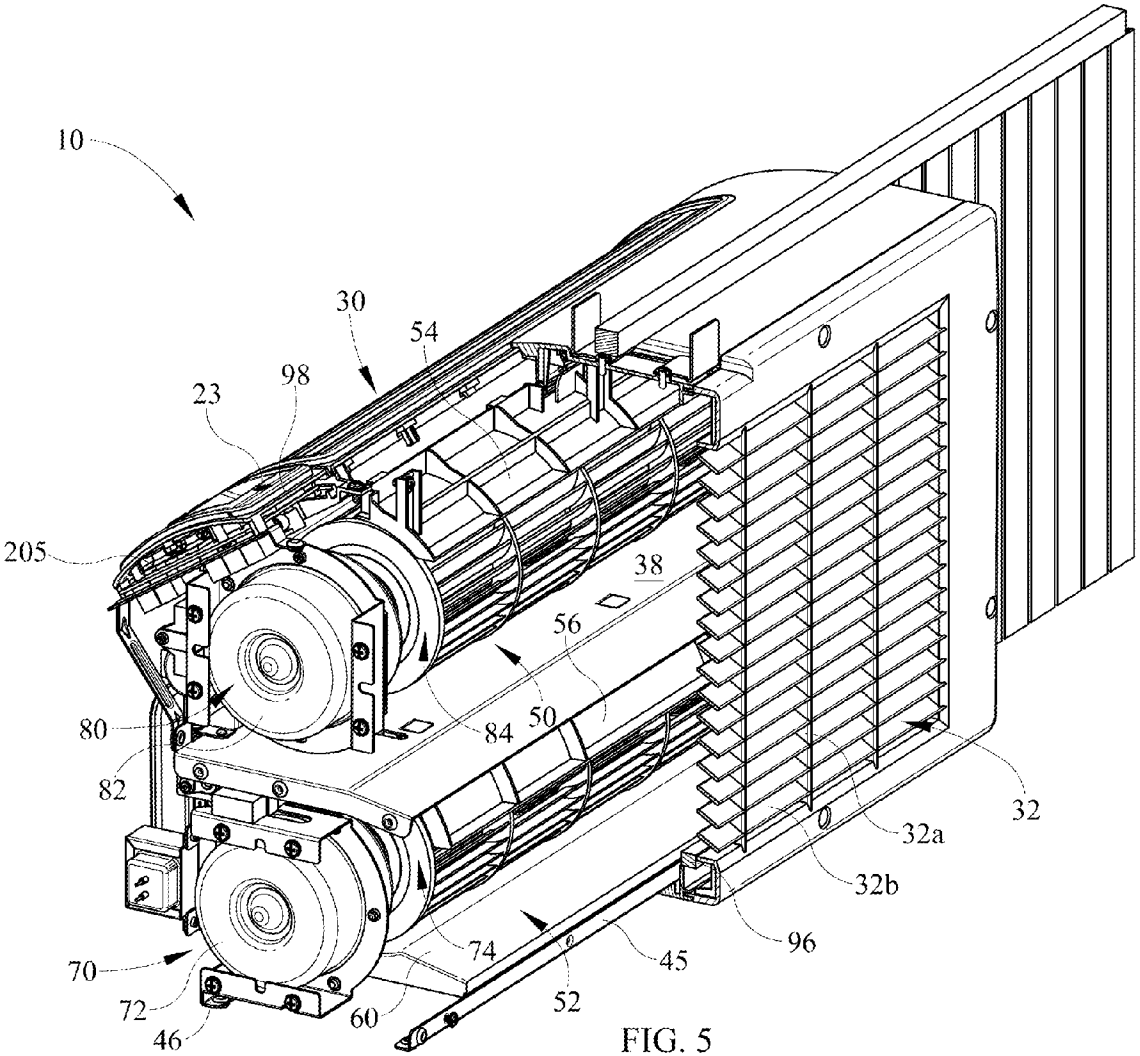
FIG. 5 is a partially sectioned perspective view of the window fan system.
Figure 6:
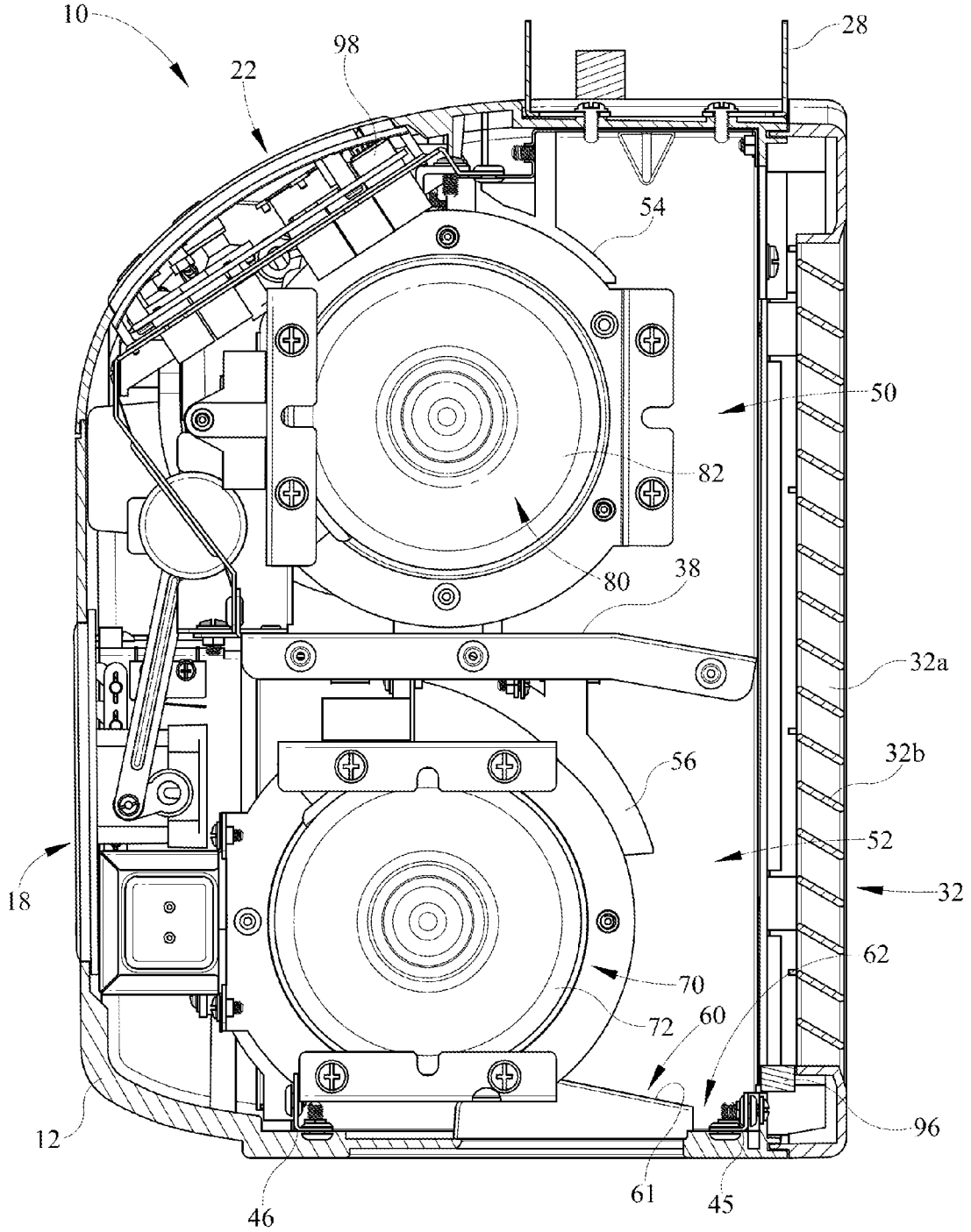
FIG. 6 is a side section view of the window fan system.

Referring now to FIGS. 5 and 6, a partially sectioned rear perspective view and side sectioned view of the window fan unit 10 are depicted. The rear louver 32 comprises a plurality of vertical fins 32*a* and a plurality of horizontally extending fins 32*b*. The horizontally extending fins 32*b* are tilted at an angle which slopes downward from the inside of the system 10 to the outside. The fins 32*a*, 32*b* are fixed and are sloped in order to deflect rain which might otherwise be pulled into the lower half of the louver 32 and into the lower intake portion 52. According to the exemplary embodiment, the slope of the horizontal fins is 5%, although such slope should not be considered limiting as other slopes may be utilized. Additionally, an aspect ratio of the rear louver 32 is defined as being about two-to-one (2:1). The term aspect ratio means that, as measured between vertical fins 32*a*, the width of the horizontal fin 32*b* is twice the vertical distance between louvers. Again this aspect ratio is merely exemplary, as other ratios may be utilized. The illustrative aspect ratio is utilized also for its ability to deflect rain which may be entrained near the lower intake portion 52 of the louver 32.

From this view, one skilled in the art will realize that the upper exhaust portion 50 (FIG. 2) which blows air outwardly through the upper portion of the louver 32 also aids to clear the airspace immediately above the lower intake portion 52 (FIG. 2) of louver 32 of rain and other contaminants which may be otherwise pulled into the lower intake portion 52 by the lower fan. For purpose of this description, the term contaminants should be understood to mean rain, snow or other weather elements in addition to other elements which may be found in the outside air. Thus, the present embodiment utilizes a louver 32 having fin characteristics which aid to inhibit rain from entering the window fan system 10. The arrangement of an upper fan system 80 blowing outwardly and a lower fan 74 pulling air inwardly aids to blow rain away from the lower portion of louver 32 inhibiting rainwater from entering the window fan system 10 during use. Additionally, any rainwater which passes through the rear louver 32 may be impinged on the dam 60 adjacent the lower intake fan 74 or alternatively slowed by the dam 60 causing the water to fall or drain into the well 62.

As shown near the bottom of the window fan system 10, and between the first and second struts 45,46, the dam 60 has an upper surface 61 which generally slopes from an upper point closer to fan 74 to a lower point near the louver 32. The dam 60 receives some water which passes through the louver 32. Typically, the flow path of the water may be interrupted by the louvers 32 and this disruption in velocity causes the water droplets to fall onto the upper surface onto the dam 60. The slope of dam 60, in combination with gravity, causes water to drain down this dam slope into a well 62 (FIG. 6).

Moving away from the louver 32, beyond the dam 60, an intake fan assembly 70 is depicted. The fan assembly 70 includes a motor 72 which may be a 120 Volt motor having a high speed of approximately 1425 RPM, a medium speed of approximately 1322 RPM, and a low speed of approximately 1184 RPM. Connected to the fan motor 72 is a blower or fan 74. The blower or fan 74 may be a centripetal fan which draws air into the top portion beneath the partition 38. Alternatively, various types of fans may be used, for example centrifugal, tangential or cross-flow fans. The blower 74 is generally cylindrical in shape having a plurality of horizontal fins which may be slightly curved and connected by a plurality of axially aligned ribs. The blower 74 is operably connected to the fan motor 72 and spins about a central axis with the motor 72. In the views shown in FIGS. 5 and 6, the motor 72 rotates in a substantially counterclockwise direction which pulls air inwardly through the lower portion of louver 32 and moves the air upwardly through the blower housing 56 and expels the accelerated air through the room air exhaust 18. The blower housing 56 is connected to the partition 38 which separates the lower intake portion 52 (FIG. 2) from the upper exhaust portion 50 (FIG. 2).

Figure 7:
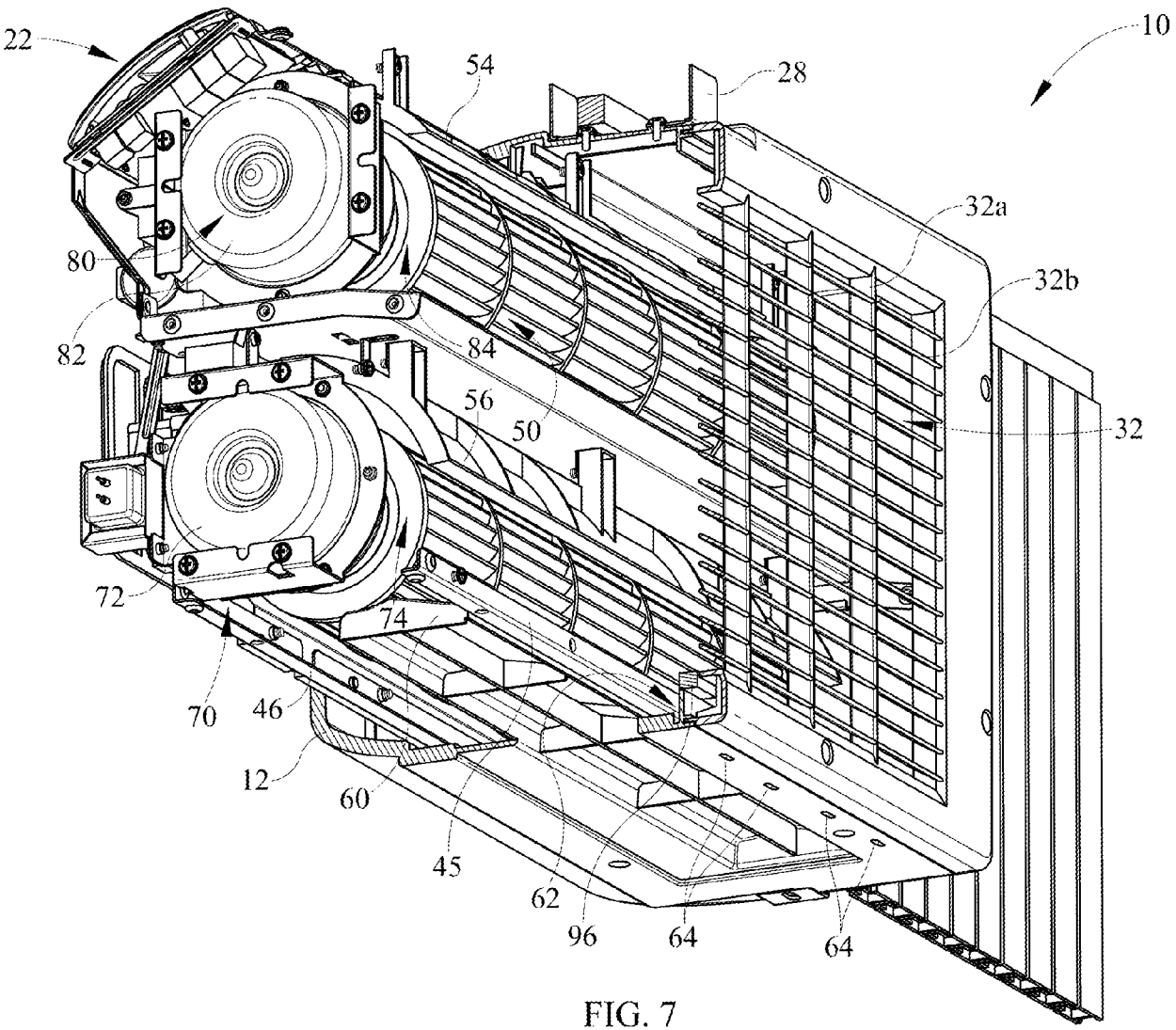
FIG. 7 is a partially sectioned lower perspective view of the window fan system.

Still referring to FIGS. 5, 6 and 7, the partition 38 includes a sloped portion closest to the rear louver 32. The sloped portion of the partition 38 also utilizes gravity to remove any water which may gather in this area of the fan and drains this water to the dam 60 or the well 62. At the downhill side of the dam 60 is a well 62. The function of the well 62 is to receive water which runs off the slope surface of the dam 60 and remove the water from the fan system 10. A plurality of apertures 64 are seen at a lower surface of the window fan unit 10. These apertures 64 function as drain holes and are located generally in the bottom of the well 62. A plurality of ribs 66 are positioned on the lower surface of the dam 60 which eliminates the need to make a solid dam 60 and saves weight while strengthening the part. As previously described the dam 60 may be separately formed or integrally formed with the housing 12, frame 40, or other parts.

Above the partition 38, an upper exhaust fan assembly 80 is positioned. Similar to the lower fan assembly 70, the upper exhaust fan assembly 80 comprises a fan motor 82 and a centripetal fan or blower 84. The upper fan assembly 80 removes air from the building interior through the room exhaust intake 30, through the blower 74 and out to atmosphere through the upper portion of the rear louver 32.

Figure 8:
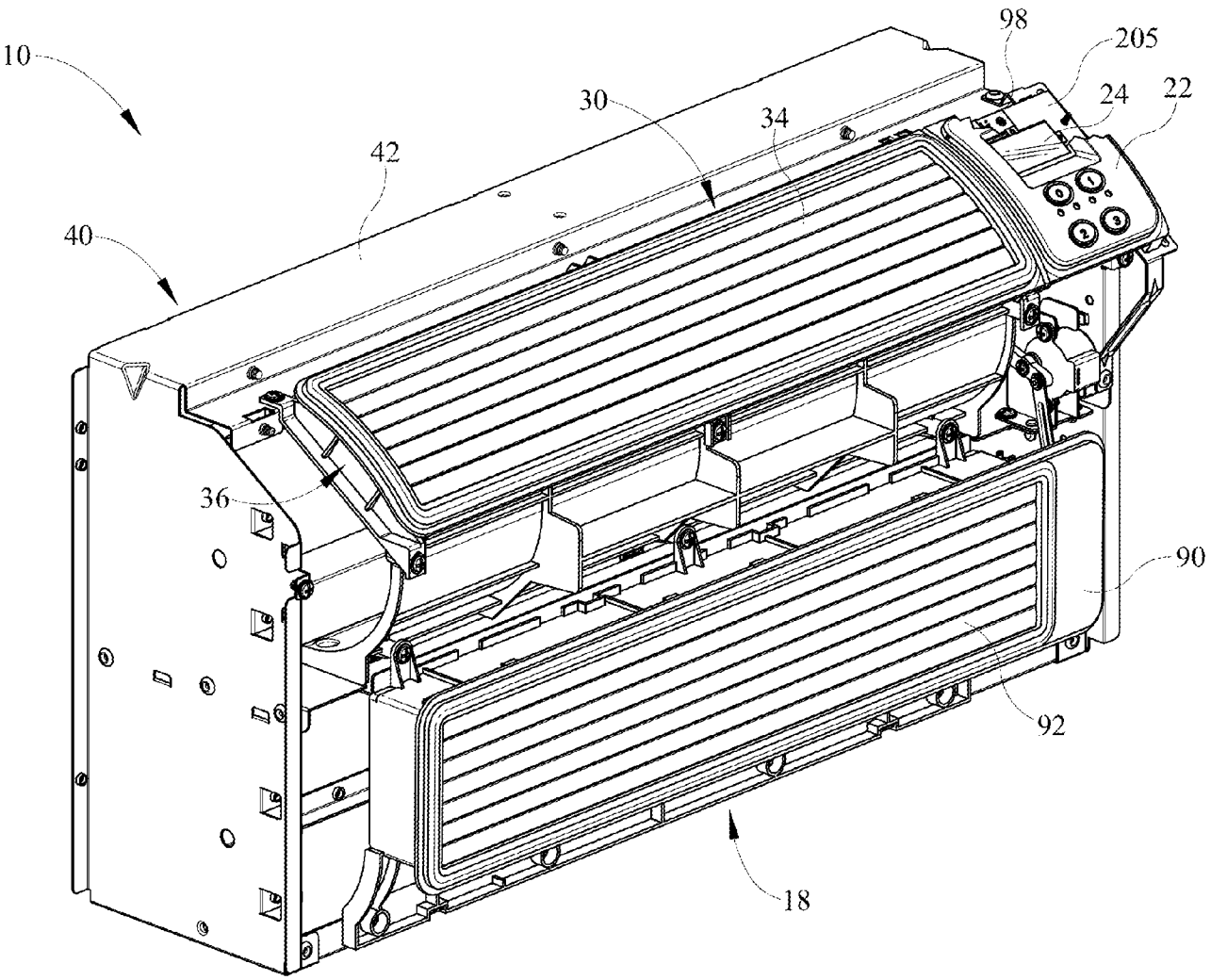
FIG. 8 is a front perspective view of the window fan unit with the housing structure removed.

Referring now to FIG. 8, the window fan unit 10 is depicted with the lower housing 12 and upper housing 20 removed. Extending from the frame 40 is a room exhaust intake 30 having a plurality of louvers 34 which are pivotally positioned within a louver frame 36. The louver frame 36 functions as a duct through which air passes from the room, through the room exhaust intake 30, louvers 34 and into the upper fan assembly 80. Beneath the louver frame 36 is the upper fan cowling 56 which is curved to proximate the curvature of the blower 84 and includes a plurality of stiffening ribs along the outer surface thereof.

Beneath the room exhaust intake 30, is the outside air exhaust 18, which also comprises a louver housing 90 and a plurality of pivotable louvers 92. The louver housing 90 also functions as a duct adjacent to the lower fan assembly 70 and allows air passage through the outside air exhaust 18 into the room or building where the window fan unit 10 is positioned.

Figure 9:
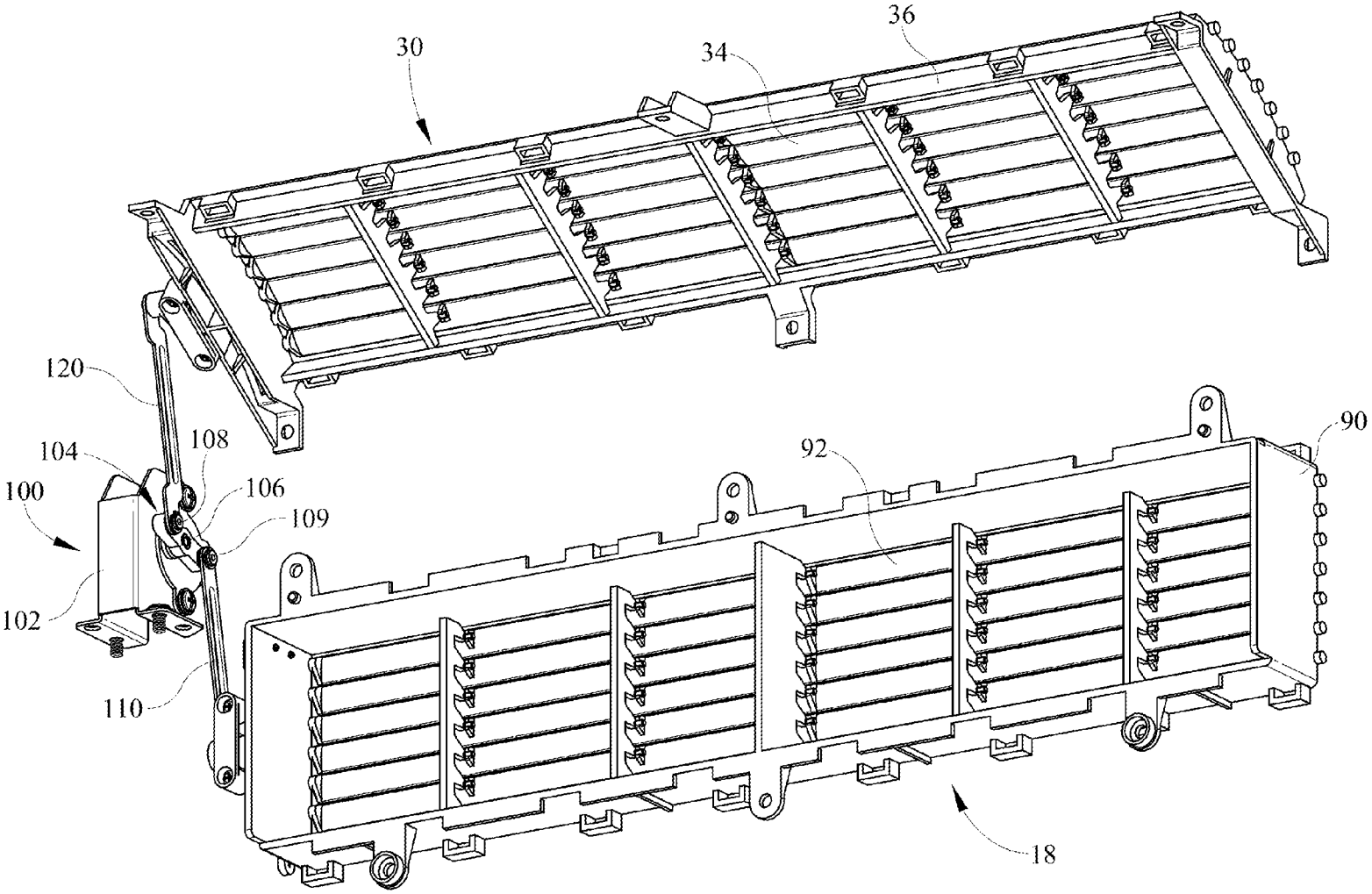
FIG. 9 is a rear perspective of the room air exhaust and room air intake including linkage removed from the window fan system.

Referring now to FIG. 9, a perspective view of the room exhaust intake 30 and the outside air exhaust 18 is shown in a rear perspective view through which air passes from a building interior to the outside of the building. The upper louver frame 36 includes a plurality of louvers 34 positioned therein. The louvers 34 may be pivoted open to allow air flow when the system 10 is in operation. Alternatively, when the window system 10 is not operating, the louvers 34 may be closed to inhibit flow of air from the interior of the room to the outside or vice versa depending on the temperature difference between the outside ambient air and the inside air temperature. The louver frame 36 includes a plurality of moldings and fastening apertures for connection to the frame 40 (FIG. 7) or other components of the system 10.

Beneath the room exhaust intake 30 is the outside air exhaust 18. The louver housing 90 defines a duct area through which air passes from the fan system 80 to the room interior. Within the lower housing 90 are a plurality of pivotally connected louvers 92 which also open and close depending on the state of the window fan system 10. The lower housing 90 also includes a plurality of moldings and apertures for connecting the lower housing 90 to the frame 40 or adjacent structure. As best seen in FIG. 8, positioned about the front area of the housings 36, 90 and louvers 34, 92 are trim elements which define portions of the outer housings 12, 20.

The louvers 34, 92 may, according to one embodiment, move independently of one another. Alternatively, in the exemplary embodiment depicted, and described hereinafter, a linkage system 100 is utilized to open and close the louvers 34, 92 simultaneously. The linkage system 100 comprises an actuator motor 102. An actuator arm 104 is operably connected to the motor with a pivot point 106 and first and second linkage connections 108,109.

Figure 10:
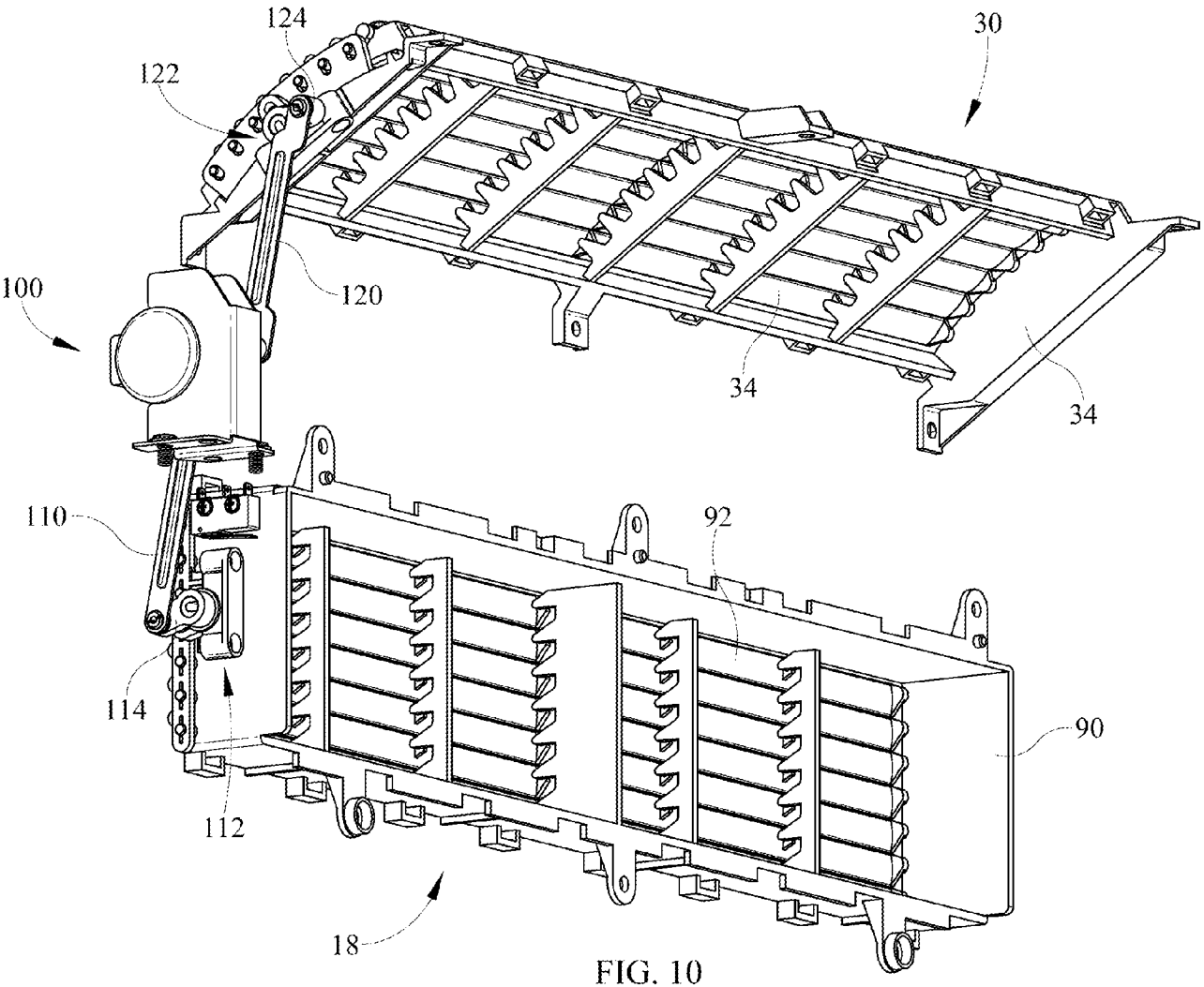
FIG. 10 is a second rear perspective view of the structure shown in FIG. 9.

Referring now to FIG. 10, a perspective view of the linkage system 100 is depicted. Connected to the arm 104 at pivot point 109 (FIG. 9) is a lower linkage 110. The lower linkage 110 connects to a lower louver pivot mechanism 112. This mechanism 112 includes at least one arm 114, connected to lower linkage 110. The upper linkage 120 extends to an upper pivot mechanism 122 having an arm 124. Both arms 114,124 pivot to move the corresponding louvers 92, 34.

Figure 11:
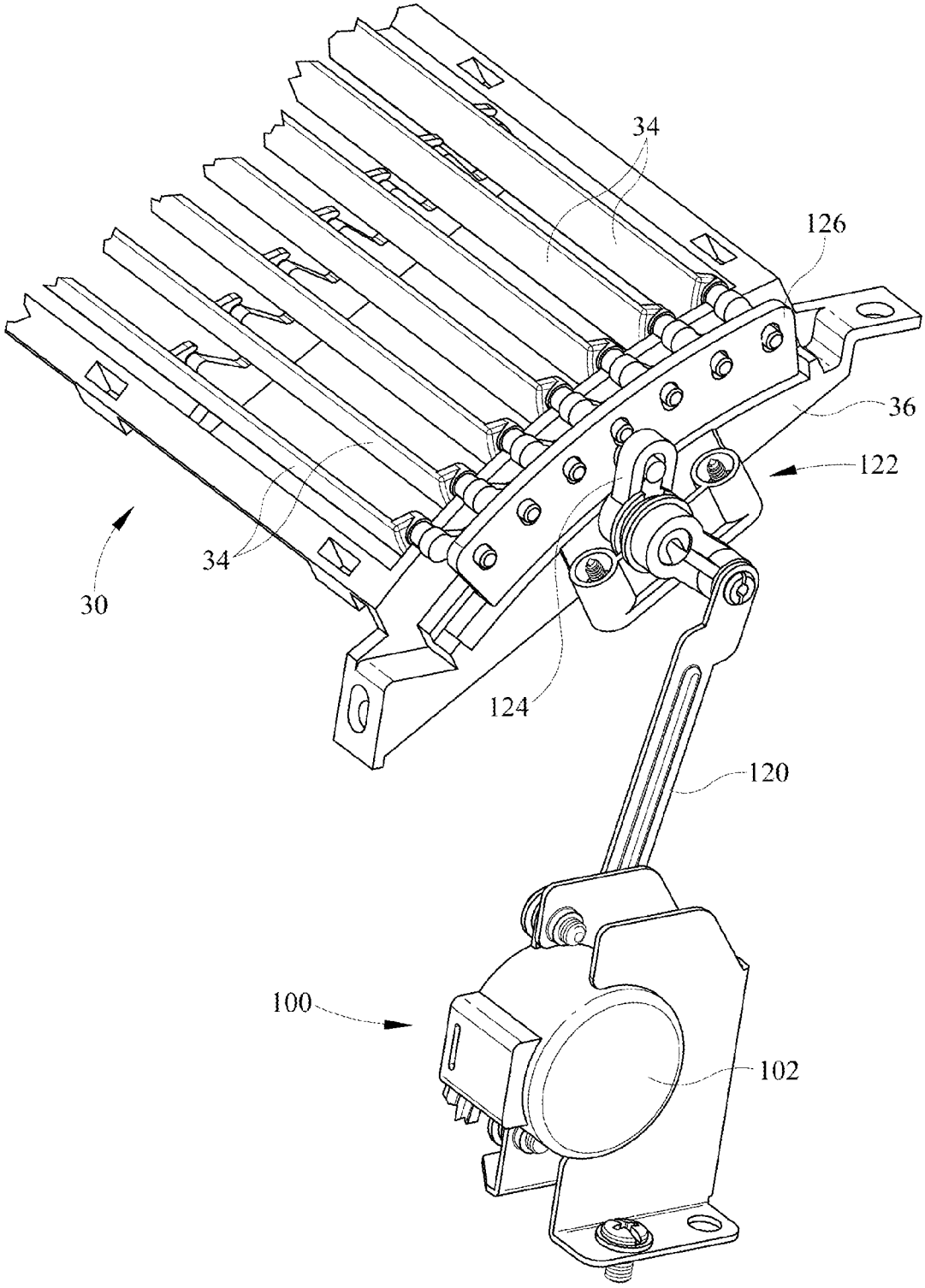
FIG. 11 is a perspective view of the linkage and louvers for the room air intake with the louvers in a first position.
Figure 12:
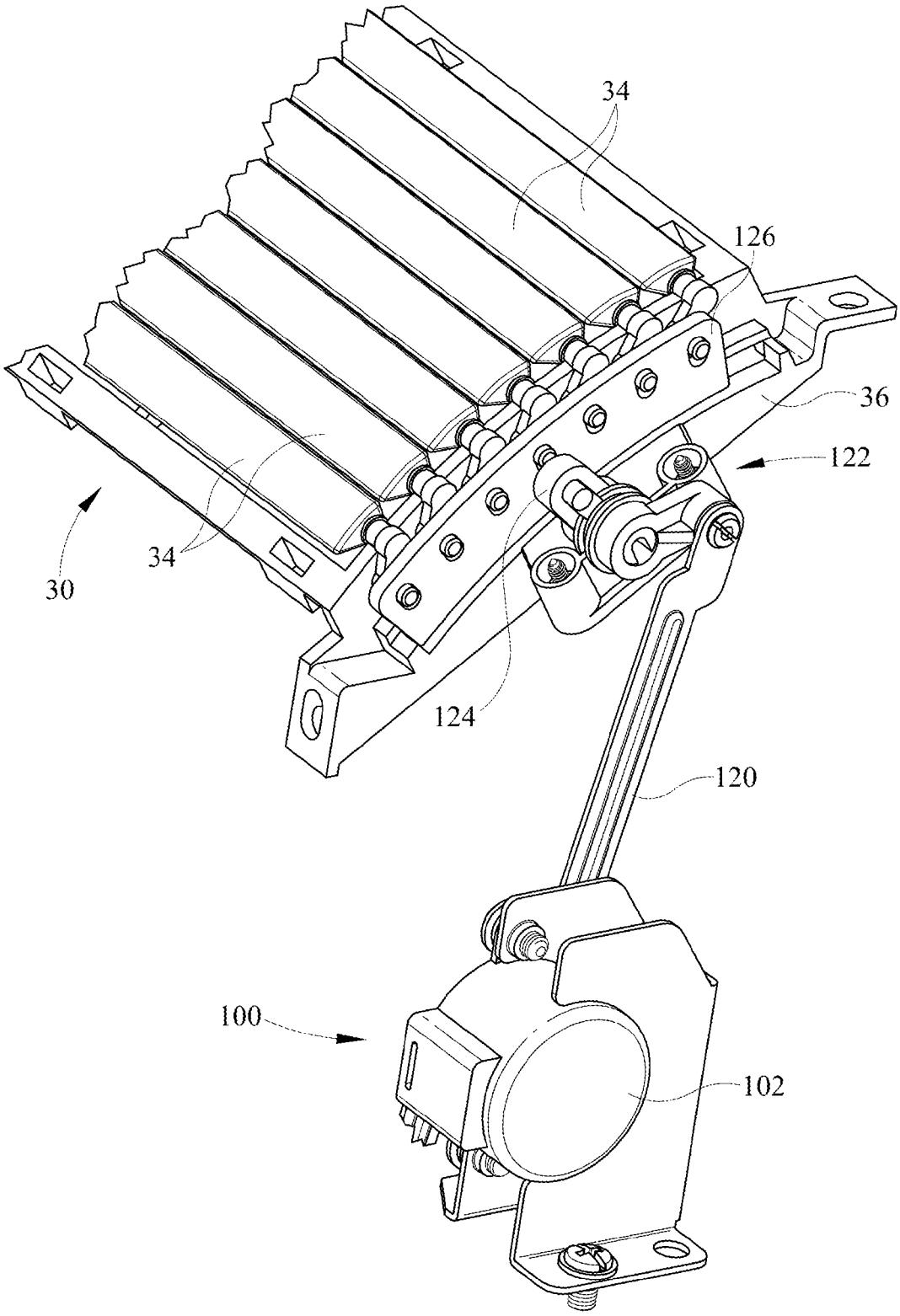
FIG. 12 is a perspective view of the linkage and louvers for the room air intake in a second position.

Referring now to FIGS. 11 and 12, perspective views of the pivot mechanism 122 are depicted with the louvers 34 in first and second positions. Arm 124 is generally v-shaped and pivotally connected to the louver frame 36. A slide member 126 is connected to the arm 124 and slides along a surface of the louver frame 136 as the arm 124 rotates with movement of linkage arm 120. Each of the louvers 34 are operably connected to the slide 126 so that movement of the arm 124 causes movement of the slide 126, and therefore movement of the louvers 34. In sum, according to the exemplary embodiment, the actuator motor 102 pivots each of the louvers 34 with a single motion via the arm 124 and slide member 126. As shown in FIG. 11, the louvers 34 are in an open position. As the arm 124 is rotated and the slide member 126 moves, the louvers 34 rotate to a closed position.

Figure 13:
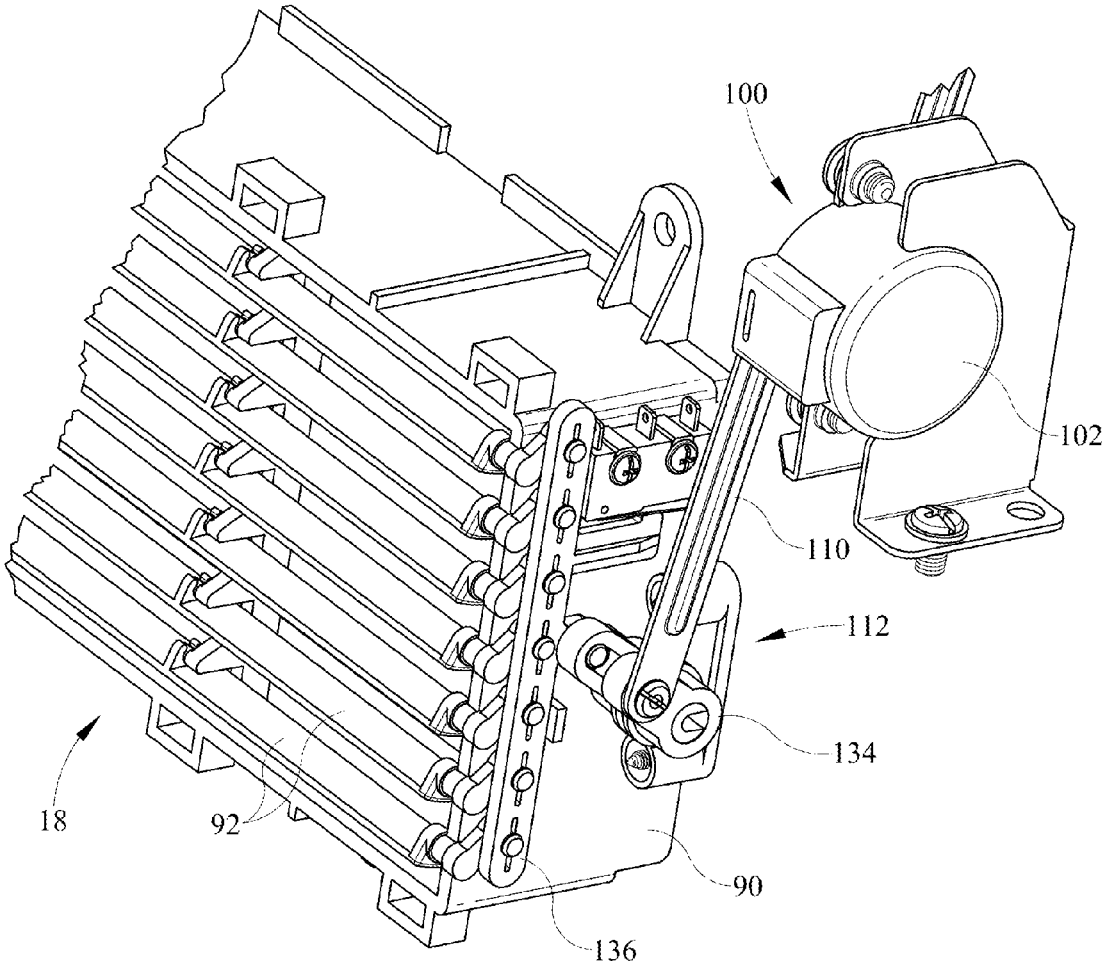
FIG. 13 is a perspective view of the linkage and louvers for the outside air exhaust with the louvers in a first position.
Figure 14:
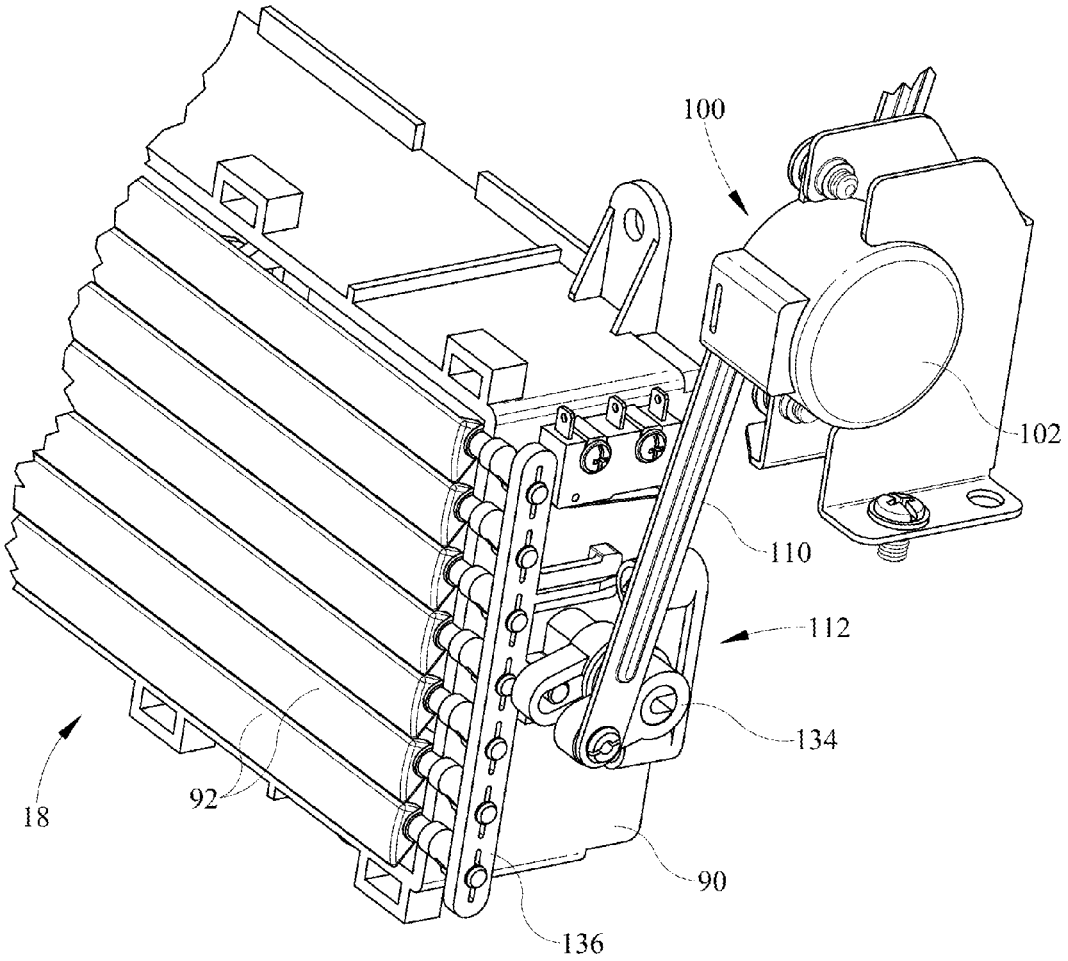
FIG. 14 is a perspective view of the linkage and louvers for the outside air exhaust with the louvers in a second position.
Figure 15:
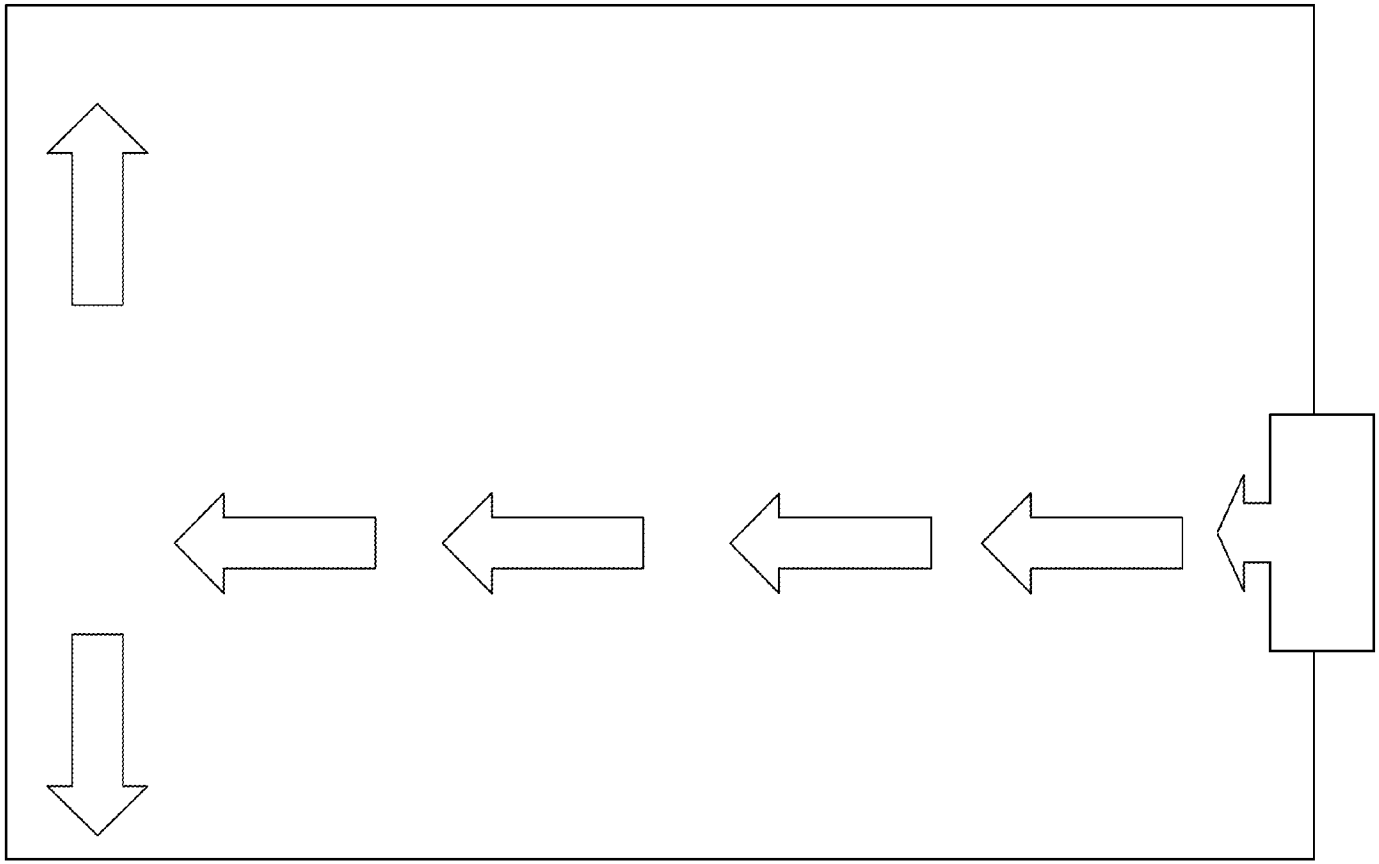
PRIOR ART FIG. 15
FIG. 15 is a side schematic of a prior art window fan having limited air movement.

Referring now to FIGS. 13 and 14, perspective views of the lower pivot mechanism 112 are depicted with the louvers in first and second positions. Depending from the actuator motor 102 is the lower linkage 110 which engages an arm 134. Extending from the lower housing 90 is a pivot structure about which the arm 134 rotates. Also connected to the arm 134 is a lower slide member 136. The plurality of louvers 92 are each pivotally connected to the slide member 136 so that rotation of the arm 134 causes pivotal movement, opening or closing, of the louvers 92.

Figure 16:
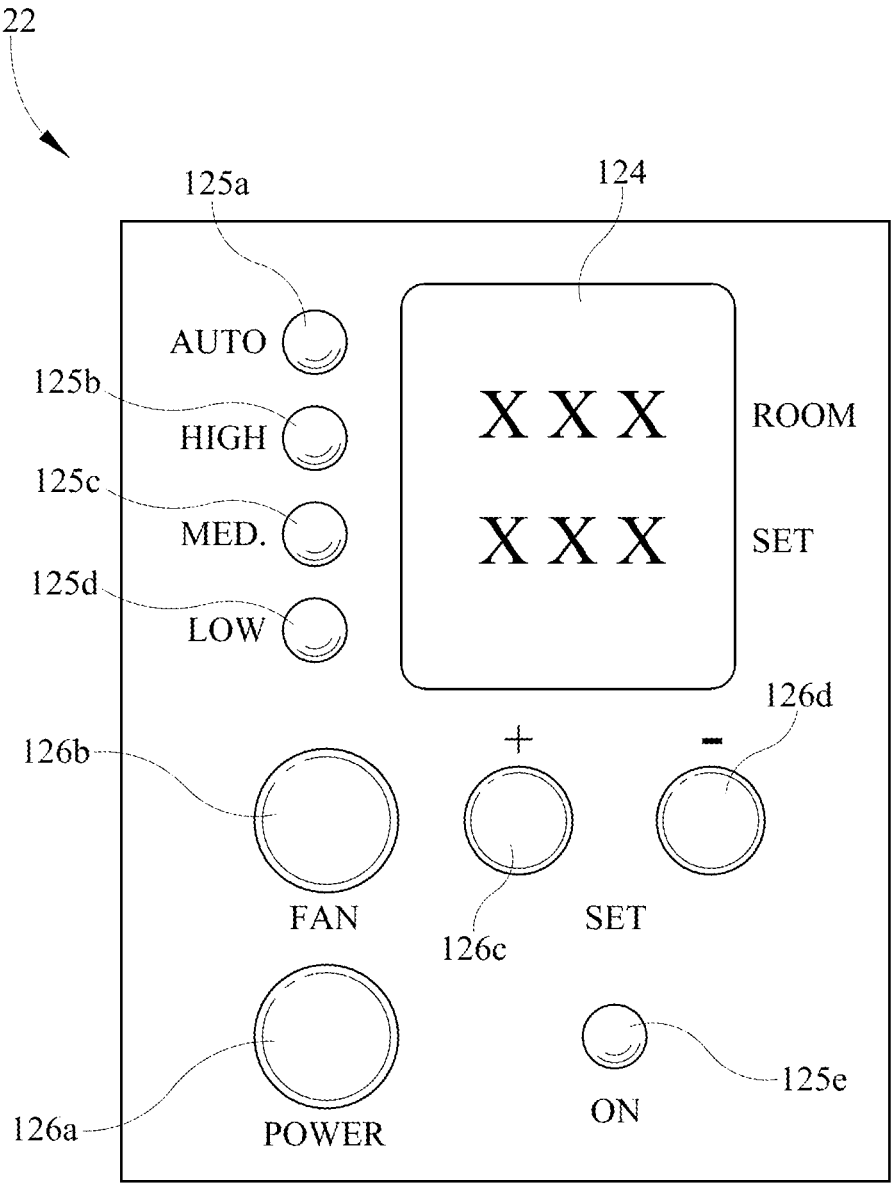
FIG. 16 is a top view of an embodiment of a control panel for use with the window fan system or other system.

Referring now to FIG. 16, a top view of a second embodiment of a control panel 122 is depicted. Both control panels 22, 122 may be in electronic communication with the fan systems 70, 80 as well as linkage system 100 for controlling the window fan system 10. Control panel 122 may be located, for example, in a similar location as control panel 22 on window fan system 10. Control panel 122 includes a display 124 that provides an area for displaying a current dry bulb temperature of the room or interior air and an area for displaying the current set point temperature that has been selected by a user. A power push button 126*a* is provided to enable a user to selectively power window fan system 10 and a fan push button 126*b* is provided to enable a user to cause lower fan 74 and upper fan 84 to be set to a low, medium, high, or automatic setting. AUTO LED 125*a*, HIGH LED 125*b*, MED LED 125*c*, and LOW LED 125*d* are selectively illuminated to convey to a user which setting is selected for lower fan 74 and upper fan 84. Similarly, ON LED 125*e* is illuminated when the window fan system 10 is powered on to convey to a user that it is powered. A set point "+" button 126*c* and a set point "–" button 126*d* are provided to enable a user to increment the set point upwardly or downwardly, respectively. The area of display 124 for displaying the current set point temperature conveys to a user the currently selected set point.

Although FIG. 16 illustrates a particular control panel 122, additional and/or alternative control interfaces may be used in conjunction with a window fan unit and/or other system, such as a central air condition system or central ducted system. As one example, a virtual control interface may be provided on a display of a stand-alone thermostat and/or on a display of a mobile phone, tablet, etc. In embodiments where a virtual control interface is provided, the virtual control interface may render various output on the display, such as current dry bulb temperature of the room or interior area, current set point(s) (AC set point and/or non-AC set point), virtual buttons or other interface elements, etc. Moreover, in embodiments where a virtual control interface is provided, a user may utilize one or more user interface input devices to adjust set point(s), fan speed, modes, etc. For example, a user may utilize a touch screen to actuate virtual buttons or other interface elements rendered in a virtual control interface, may provide spoken input via a microphone user interface input device, may user a mouse, may use a keyboard (mechanical or virtual), etc.

Figure 17:
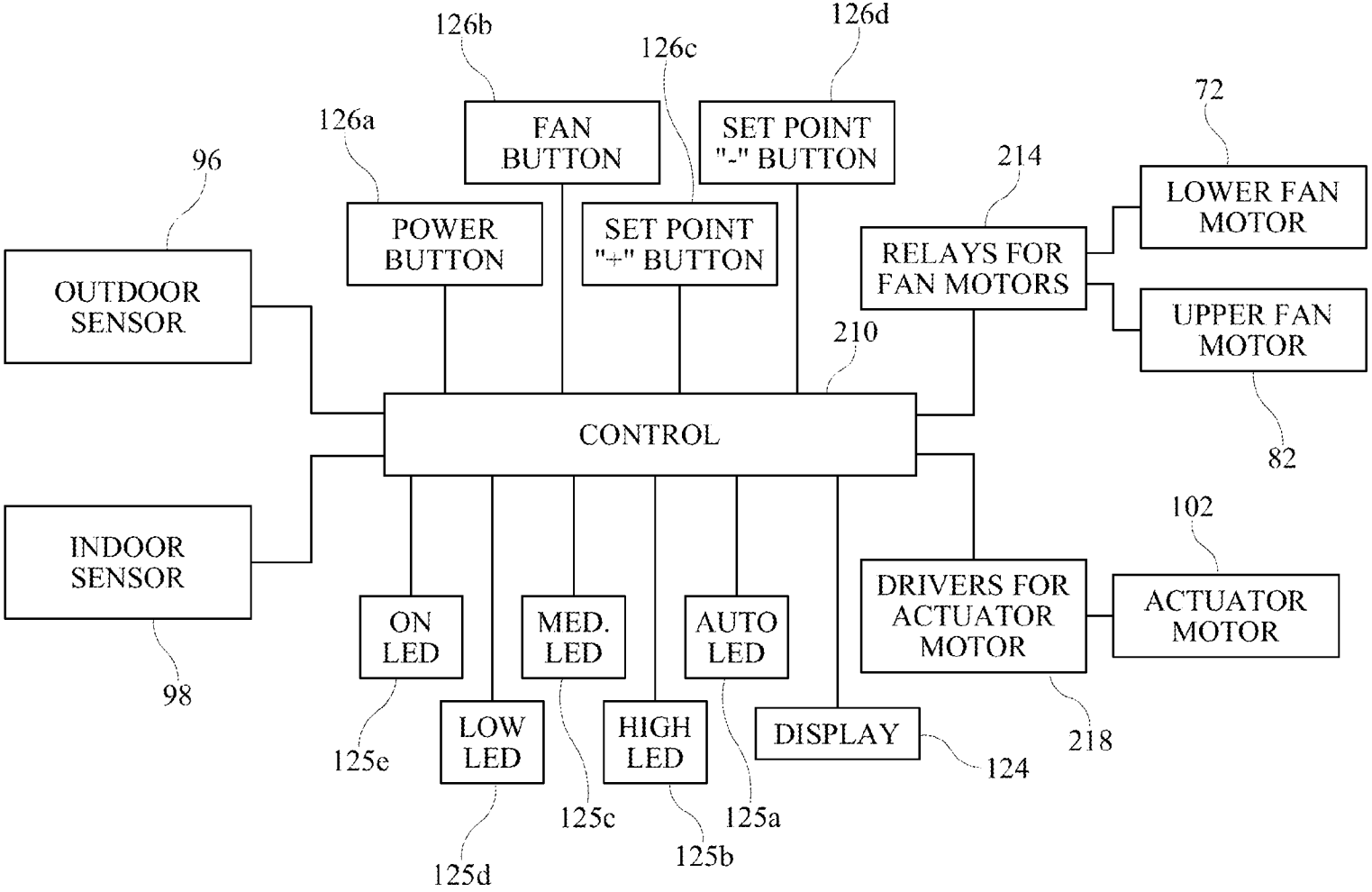
FIG. 17 is a schematic representation of an embodiment of a control system for a window fan system or other system.

Referring now to FIG. 17, a schematic representation of an embodiment of a control system for a window fan system or other system is depicted. Power button 126*a*, fan button 126*b*, set point "+" button 126*c*, and set point "–" button 126*d* of control panel 122 are in selective electrical communication with controller 210, causing one or more signals to be sent to controller 210 when they are actuated. Controller 210 is also in electrical communication with AUTO LED 125*a*, HIGH LED 125*b*, MED LED 125*c*, LOW LED 125*d*, and ON LED 125*e* of control panel 122 and is programmed to selectively illuminate the LEDs based on input received from a user via power button 126*a*, fan button 126*b*, set point "+" button 126*c*, and/or set point "–" button 126*d*. Outdoor sensor 96 and indoor sensor 98 are also in electrical communication with controller 210 and may communicate one or more signals to controller 210 that are indicative of one or more characteristics of exterior air and interior air, respectively. Such characteristics include, without limitation, dry bulb temperature, wet bulb temperature, absolute humidity, specific humidity, relative humidity, pressure, and/or dew point temperature. Controller 210 is also in electrical communication with relays 214 for lower fan motor 72 and upper fan motor 82 and drivers 218 for actuator motor 102. The relays 214 are in electrical communication with lower fan motor 72 and upper fan motor 82 and can be selectively activated to cause lower fan motor 72 and upper fan motor 82 to be driven at a desired speed of a plurality of speeds. In some embodiments three relays are provided and may be selectively activated to drive lower fan motor 72 and upper fan motor 82 at either a low, medium, or high speed. The drivers 218 are in electrical communication with actuator motor 102 and may be selectively activated to accurately control actuator motor 102 and, resultantly, louvers 34 and 92. In some embodiments four driver channels may be provided in electrical communication with actuator motor 102 and may be selectively activated to provide full stepping or half stepping of the actuator motor 102.

In some embodiments Power button 126*a*, fan button 126*b*, set point "+" button 126*c* and set point "–" button 126*d* may be membrane type buttons that engage a corresponding switch on a circuit board adjacent the control panel 122 when actuated. The circuit board may also include the controller 210, AUTO LED 125*a*, HIGH LED 125*b*, MED LED 125*c*, LOW LED 125*d*, ON LED 125*e*, display 124, relays 214 for lower fan motor 72 and upper fan motor 82, and/or drivers 218 for the actuator motor 102. The control may be a PIC microcontroller model number PIC18LF4331-1/PT, the actuator motor 102 may be a PM Step Motor 24BYJ model manufactured by Best Electronics Industrials Co., Ltd., and outdoor sensor 96 and indoor sensor 98 may be Relative Humidity and Temperature Modules HTG3500 Series manufactured by Measurement Specialties. In some embodiments, the controller 210 and/or other components of the control system may be located remote from other components of the control system. For example, where a virtual control interface is provided the virtual control interface may be rendered on a computing device of a user, and the controller 210 may be housed in a window fan system or in a control panel of a central air condition system or central ducted system. The virtual control interface and/or other interface and the controller 210 and/or other component(s) may be in communication through one or more wired connections and/or one or more wireless connections (e.g., via a network interface controller).

Referring briefly to FIGS. 5-7, outdoor sensor 96 may be located just inside louver 32 near the base of louver 32 and strut 45. In the depicted embodiment the outdoor sensor 96 is located near lower intake portion 52 so as to be appropriately exposed to exterior air. Referring briefly to FIG. 8 where a portion of control panel 22 is shown cut away, and to FIGS. 5 and 6, indoor sensor 98 may be located on a circuit board 205 adjacent the control panel 22 in a position so as to be exposed to the interior air and be relatively unaffected by any heat generated by other components attached to the circuit board 205. In FIGS. 1 and 5 apertures 23 are shown that extend through control panel 22 to enable indoor sensor 98 to be appropriately exposed to indoor air. Outdoor sensor 96 and indoor sensor 98 may be located elsewhere on window fan system 10 or may be located remote from window fan system 10 or other system, so long as they are located to be responsive to one or more characteristics of the exterior air and interior air, respectively. Outdoor sensor 96 and indoor sensor 98 may be in wired or wireless electronic communication with electronic controller 210.

Figure 18:
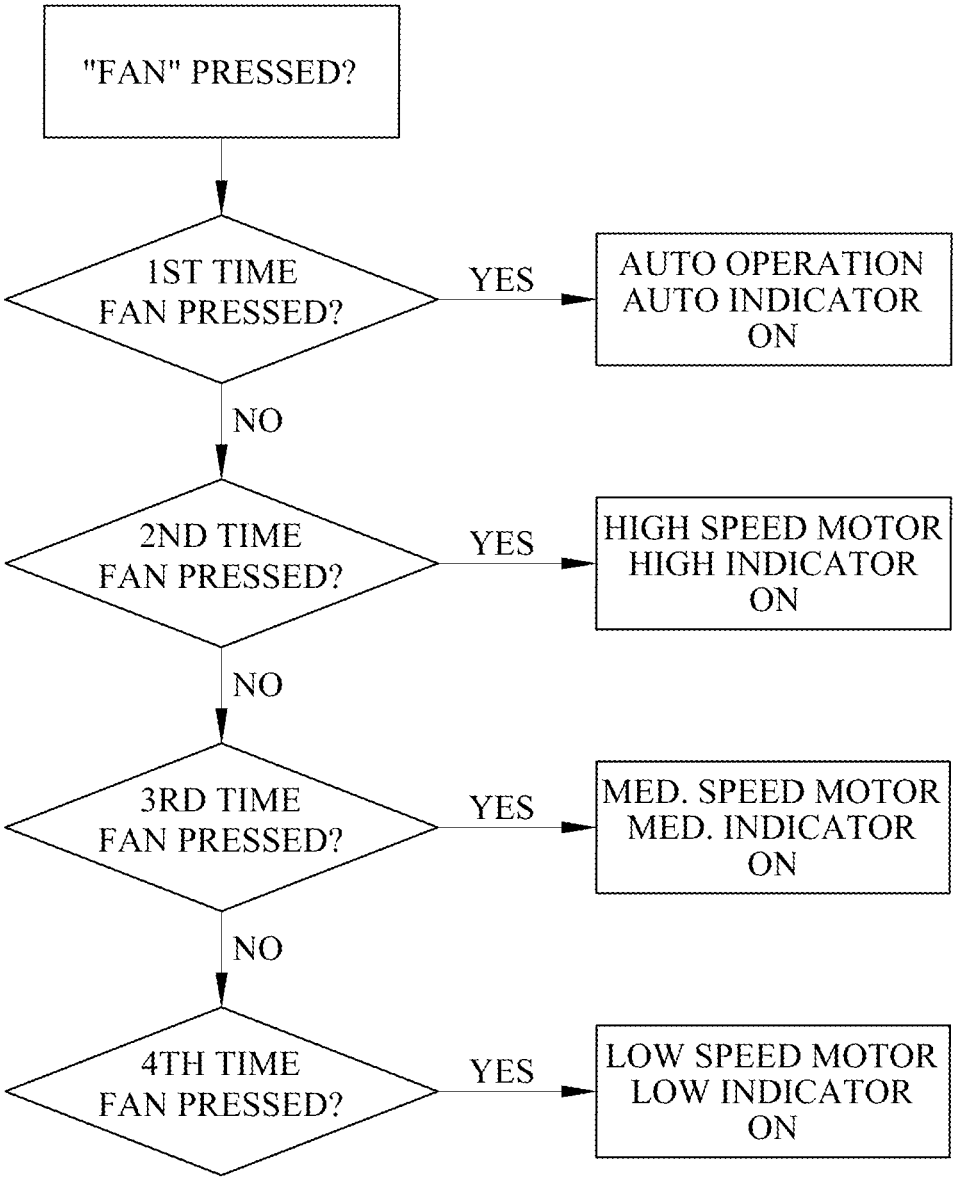
FIG. 18 is a flow diagram of an embodiment of the generalized logic of a controller when a fan button of the window fan system or other system is actuated by a user.

Referring now to FIG. 18, a flow diagram shows an embodiment of the generalized logic of controller 210 when fan button 126*b* is actuated by a user. If it is the first time fan button 126*b* has been pressed, the controller 210 causes AUTO LED 125*a* to be illuminated and controller 210 automatically operates the window fan system 10. An embodiment of the automatic operation of the window fan system is shown in detail in FIG. 20 and described in detail hereinafter. If it is the second time fan button 126*b* has been pressed, the controller 210 causes HIGH LED 125*b* to be illuminated, communicates with relays 214 to cause them to all be activated, causing lower fan motor 72 and upper fan motor 82 to operate at a high speed. Controller 210 also communicates with drivers 218 to ensure actuator motor 102 is appropriately stepped to place louvers 34 and 92 in an open position to allow airflow through window fan system 10. If it is the third time fan button 126*b* has been pressed, the controller 210 causes MED LED 125*c* to be illuminated, communicates with relays 214 to cause two relays to be activated, causing lower fan motor 72 and upper fan motor 82 to operate at a medium speed. Controller 210 also communicates with drivers 218 to ensure actuator motor 102 is appropriately stepped to place louvers 34 and 92 in an open position to allow airflow through window fan system 10. If it is the fourth time fan button 126*b* has been pressed, the controller 210 causes LOW LED 125*d* to be illuminated, communicates with relays 214 to cause a single relay to be activated, causing lower fan motor 72 and upper fan motor 82 to operate at a low speed. Controller 210 also communicates with drivers 218 to ensure actuator motor 102 is appropriately stepped to place louvers 34 and 92 in an open position to allow airflow through window fan system 10.

Figure 19:
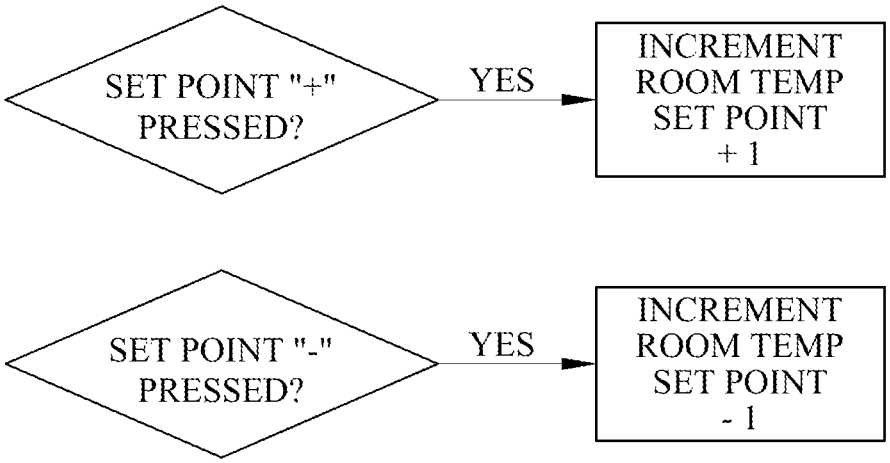
FIG. 19 is a flow diagram of an embodiment of the generalized logic of a controller when a set point adjustment button of the window fan system or other system is actuated by a user.

Referring now to FIG. 19, a flow diagram shows an embodiment of the generalized logic of controller 210 when set point "+" button 126*c* is actuated by a user and when set point "–" button 126*d* is actuated by a user. If the set point "+" button 126*c* is actuated controller 210 increments the currently stored set point up by one degree. The controller 210 also causes the area of display 124 that displays the current set point temperature to be updated to reflect the current set point temperature selected. If the set point "–" button 126*d* is actuated controller 210 increments the currently stored set point down by one degree. The controller 210 also causes the area of display 124 that displays the current set point temperature to be updated to reflect the current set point temperature selected. In alternative embodiments increments smaller or larger than one degree may be used.

Figure 20:
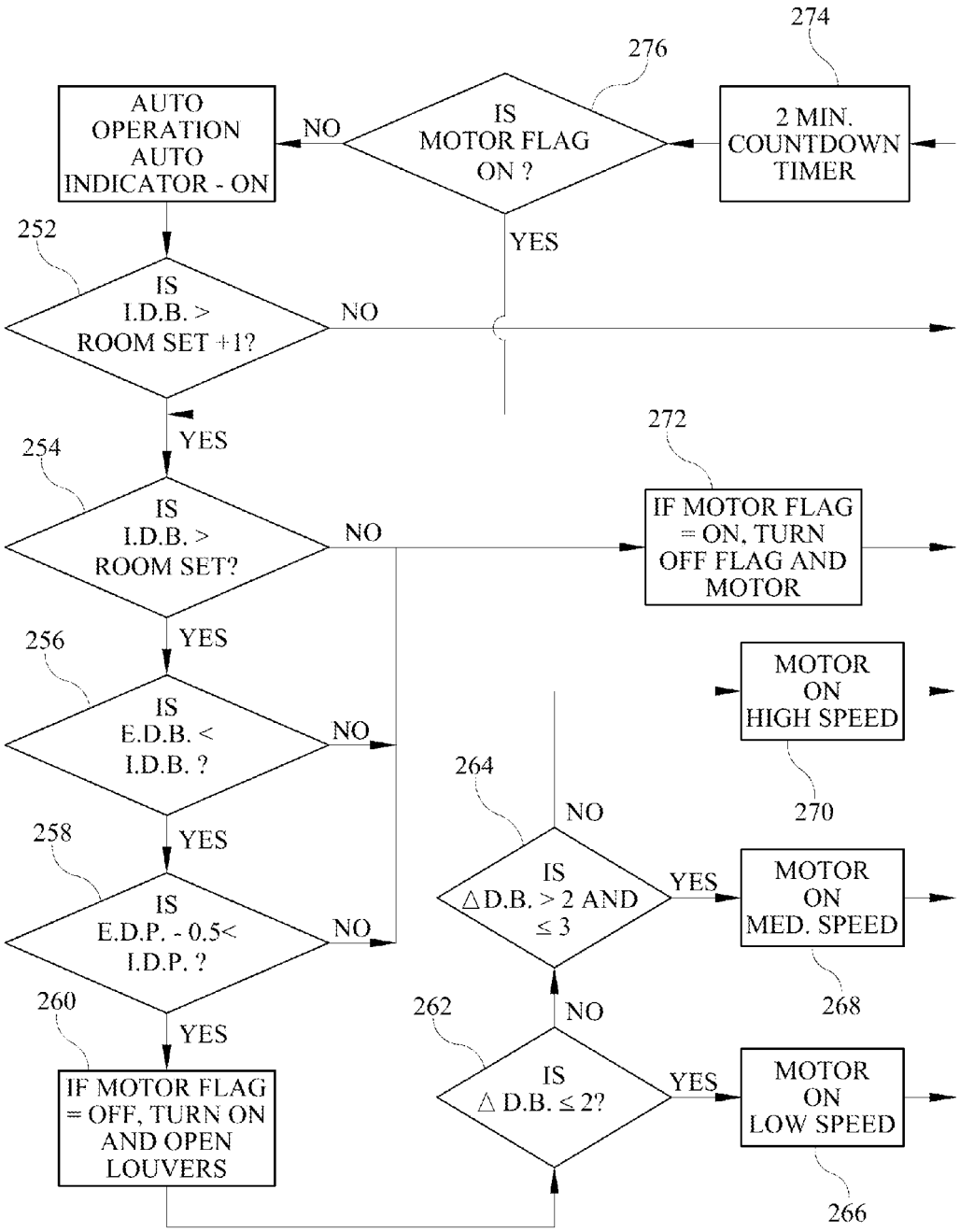
FIG. 20 is a flow diagram of an embodiment of the generalized logic of a controller when automatically operating the window fan system or other system.

Referring now to FIG. 20, a flow diagram shows an embodiment of the generalized logic of controller 210 automatically operating the window fan system 10 or other system. In the flow diagram of FIG. 20 interior dry bulb temperature (I. D. B.), exterior dry bulb temperature (E. D. B.), interior dew point (I. D. P), and exterior dew point (E. D. P.) are analyzed by controller 210. In some embodiments indoor sensor 98 and outdoor sensor 96 supply signals to controller 210 that are indicative of measured interior and exterior dry bulb temperatures and relative humidity levels and controller 210 calculates an interior and exterior dew point that correspond to the measured interior and exterior dry bulb temperatures and relative humidity levels. In some embodiments controller 210 could calculate dew points by referencing a table, such as a table containing dry bulb temperatures, relative humidity levels, and dew point temperatures to determine a dew point temperature that corresponds to the measured dry bulb temperature and relative humidity level. In some embodiments controller 210 could calculate dew points by using one or more formulas. For example, the dew point could be calculated using the formula: Dew Point Temperature=[(17.271*Dry Bulb Temperature)/(237.7+Dry Bulb Temperature)]+ln(Relative Humidity/100), where the temperatures are in degrees Celsius and "ln" refers to the natural logarithm.

In other embodiments indoor sensor 98 and outdoor sensor 96 could measure alternative or additional characteristics of the interior and exterior air and supply signals to controller 210 indicative of such characteristics. Such characteristics include, without limitation, dry bulb temperature, wet bulb temperature, absolute humidity, specific humidity, relative humidity, pressure, and/or dew point temperature. Controller 210 could then use these alternative or additional characteristics to compare, either directly or indirectly, exterior and interior dry bulb temperatures and exterior and interior dew points for use in the automatic operation of the window fan system 10. For example, instead of measuring interior and exterior relative humidity, determining the interior and exterior dew point from the relative humidity measurements, and directly comparing the interior and exterior dew point, interior and exterior relative humidity could be measured, interior and exterior specific relative humidity determined from the relative humidity measurements, and interior and exterior specific relative humidity directly compared. Comparison of the exterior specific humidity and interior specific humidity may indirectly indicate the exterior dew point is less than the interior dew point. For example, if the exterior specific humidity is less than the interior specific humidity it may indirectly indicate that the exterior dew point is less than the interior dew point. Other characteristics of exterior and/or interior air may be measured and analyzed to directly or indirectly determine if the exterior dew point is less than an interior dew point. Temperatures can be set, measured, calculated, and/or displayed in Celsius and/or Fahrenheit as desired.

If automatic operation of the window fan system 10 has been chosen by a user, at step 252 controller 210 determines if the interior dry bulb temperature as indicated by indoor sensor 98 is greater than the current set point temperature plus one degree. Comparing the interior dry bulb temperature to the current set point temperature plus one degree at this point in the flow diagram prevents excessive cycling of the lower fan motor 72 and upper fan motor 82. If at step 252 the interior dry bulb temperature is determined to be greater than the current set point temperature plus one degree, at step 254 controller 210 determines if the interior dry bulb temperature is greater than the current set point. If the interior dry bulb temperature is greater than the current set point, at step 256 controller 210 determines if the exterior dry bulb temperature is less than the interior dry bulb temperature. If the exterior dry bulb temperature is less than the interior dry bulb temperature, at step 258 controller 210 determines if the exterior dew point minus five tenths is less than the interior dew point. If so, at step 260 then the controller 210 turns the motor flag on and opens louvers 34 and 92.

The controller 210 then determines at step 262 if the difference between the interior dry bulb temperature and the current set point temperature (ΔD.B.) is less than or equal to two. If so, at step 266 the controller 210 activates the necessary relays to drive the lower fan motor 72 and upper fan motor 82 at low speed. If the difference between the interior dry bulb temperature and the current set point temperature is not less than or equal to two, the controller 210 determines at step 264 if the difference between the interior dry bulb temperature and the current set point temperature is greater than two and less than or equal to three. If so, at step 268 the controller 210 activates the necessary relays to drive the lower fan motor 72 and upper fan motor 82 at medium speed. If the difference between the interior dry bulb temperature and the current set point temperature is not greater than two and less than or equal to three, then at step 270 the controller 210 activates the necessary relays to drive the lower fan motor 72 and upper fan motor 82 at high speed. In other embodiments more or fewer than three fan speeds corresponding to more or fewer temperature differentials may be provided. For example, in some embodiments one or more fans may be driven at five preselected speeds corresponding to five different temperature differential ranges. Also, for example, in some embodiments one or more fans may be driven at a plurality of continuously variable speeds each corresponding to a temperature differential.

Once the controller 210 has activated the necessary controls to drive the lower fan motor 72 and upper fan motor 82 at low speed in step 266, medium speed in step 268, or high speed in step 270, a two minute countdown timer is started in step 274. After the two minute timer is completed the controller 210 checks to see if the motor flag is on in step 276 (the motor flag will be on if the conditions of steps 254, 256, and 258 were met in the previous loop). If the motor flag is on then controller 210 will proceed to determine if the conditions of steps 254, 256, and 258 continue to be met. If the conditions of steps 254, 256, and 258 are met, controller 210 will again check the difference between the interior dry bulb temperature and the current set point temperature at steps 262 and 264 to determine if the speed at which the lower fan motor 72 and upper fan motor 82 are being driven needs to be adjusted. If the conditions of steps 254, 256, or 258 are not met than at step 272 the motor flag will be turned off if it is on, lower fan motor 72 and upper fan motor 82 will also be turned off, and then the two minute timer of step 274 executed. Following execution of the two minute timer, the process will proceed to step 252 (since the motor flag is no longer on) to determine if the indoor dry bulb temperature is greater than the current set point temperature plus one degree. If the interior dry bulb temperature is not greater than the current set point temperature plus one degree, controller 210 again executes a two minute timer at step 274 and after the timer has run again proceeds to step 252 to determine if the indoor dry bulb temperature is greater than the current set point plus one degree.

Automatic operation of the window fan system 10 will continue until a user chooses a different fan setting through actuation of fan button **126*b* or powers the window fan system down through actuation of power button 126*a*. Automatic operation of the window fan system 10 brings exterior air into an interior area and exhausts interior air to an exterior area when doing so would be advantageous in cooling the interior area as desired by a user. Automatic operation of the window fan system 10 may result in energy savings without requiring consistent monitoring by a user and without the need to sync the window fan system 10** with an air conditioner or other device.

The methods and control systems described herein, as well as variations thereof, may be implemented in an air conditioning unit that includes a compressor and one or more fans that selectively draw exterior air into an interior area. Such one or more fans may also selectively draw in interior air, circulate the interior air over cooling coils, and exhaust the circulated air back into the interior area. Such an air conditioning unit may also include one or more fans that selectively exhaust interior air to an exterior area. Such one or more fans may also selectively draw in exterior air, circulate the exterior air over a condenser, and exhaust the circulated air back into the exterior area. The compressor of the air conditioning unit may be selectively deactivated when, for example, bringing exterior air into an interior area and/or exhausting interior air to an exterior area would be advantageous in cooling the interior area.

For example, a hotel room air conditioning unit or a window room air conditioner unit may be installed in a wall or window and extend between a room and the outside. The air conditioning unit may include an interior sensor that monitors one or more characteristics of the air in the hotel room and an exterior sensor that monitors one or more characteristics of the outside air. The air conditioning unit may include a fan that selectively draws air from the outside and into the hotel room. Such a fan may be the same as, or distinct from, a primary air conditioning fan that blows air into the hotel room that has first been cooled through an evaporator or other device. The air that is cooled by an evaporator or other device may optionally be drawn from inside the hotel room. The air conditioning unit may be programmed to utilize the compressor to cool air being blown from the air conditioning unit into a room interior when, for example, the desired set point is less than the current room interior temperature and bringing exterior air into the room interior would not be advantageous in cooling the interior area. The hotel room air conditioning unit may further be programmed to deactivate the compressor and provide exterior air into the room interior when, for example, the desired cooling temperature is less than the current room interior temperature and bringing exterior air into the room interior would be advantageous in cooling the interior area. Such an air conditioning unit may also optionally include a second fan that selectively draws air from the exterior area, forces the air over a condenser, and expels the air back into the exterior area. The second fan may perform such functionality at least when the compressor is activated. The second fan may also optionally function to expel interior air to an exterior area when, for example, the compressor is deactivated.

AC operation may be desired in such a hotel room air conditioning unit at least when at least one characteristic of the interior air indicates a dry bulb temperature of the interior air is above the current set point and at least one of two conditions is met. The first condition being that at least one characteristic of the exterior air indicates a dry bulb temperature of the exterior air is greater than the dry bulb temperature of the interior air. The second condition being that at least one characteristic of the exterior air indicates a dew point of the exterior air is greater than a dew point of the interior air. Optionally, a separate AC set point may be provided that is a greater temperature than the set point for fan only non-AC operation. For example, the AC set point may be eighty degrees and the fan only set point may be seventy degrees. Accordingly, the window fan may operate with AC functionality at least when a dry bulb temperature of the interior air is above the current AC set point and either: a) at least one characteristic of the exterior air indicates a dry bulb temperature of the exterior air is greater than the dry bulb temperature of the interior air or b) at least one characteristic of the exterior air indicates a dew point of the exterior air is greater than a dew point of the interior air. The window fan may operate with fan only operation when at least one characteristic of the interior air indicates a dry bulb temperature of the interior air is greater than the current fan only set point, the dry bulb temperature of the exterior air is less than the dry bulb temperature of the interior air, and the dew point of the exterior air is less than (or equal to) the dew point of the interior air. In some embodiments, the window fan may operate the compressor and provide exterior air over an evaporator coupled to the compressor and into the room interior when, for example, at least one desired cooling temperature (i.e., an AC set point and/or a non-AC set point) is less than the current room interior temperature and bringing exterior air into the room interior would be advantageous in cooling the interior area.

Certain aspects of the description provided herein related to methods and control systems that selectively operate one or more fans and/or a compressor based on various criteria are described with respect to examples that focus on a window fan unit installable in a window or other opening. However, one of ordinary skill in the art, having had the benefit of the present disclosure, will recognize and appreciate that various methods and control systems herein may be implemented in conjunction with a central air conditioning system or central ducted system. For example, a central air conditioning system may include at least one fan that selectively draws air from an exterior area into an interior area. For instance, a controller of the central air conditioning system may selectively open one or more barriers in ducting to enable a fan thereof to pull in exterior air from an exterior area into an interior area. Also, for instance, the controller may selectively close the one or more barriers to enable the fan (and/or an additional fan) to circulate interior air without pulling in exterior air via open barriers). Moreover, the central air conditioning system may further include a compressor that is coupled to an evaporator, located in the interior area, and one or more of the fans of the system may circulate air (interior and/or exterior air) over the evaporator to actively cool and/or dehumidify the air as it is circulated over the evaporator. It is understood that various aspects of the control system and/or methods described herein are equally applicable to such central air conditioning systems or central ducted systems.

Figure 21A:
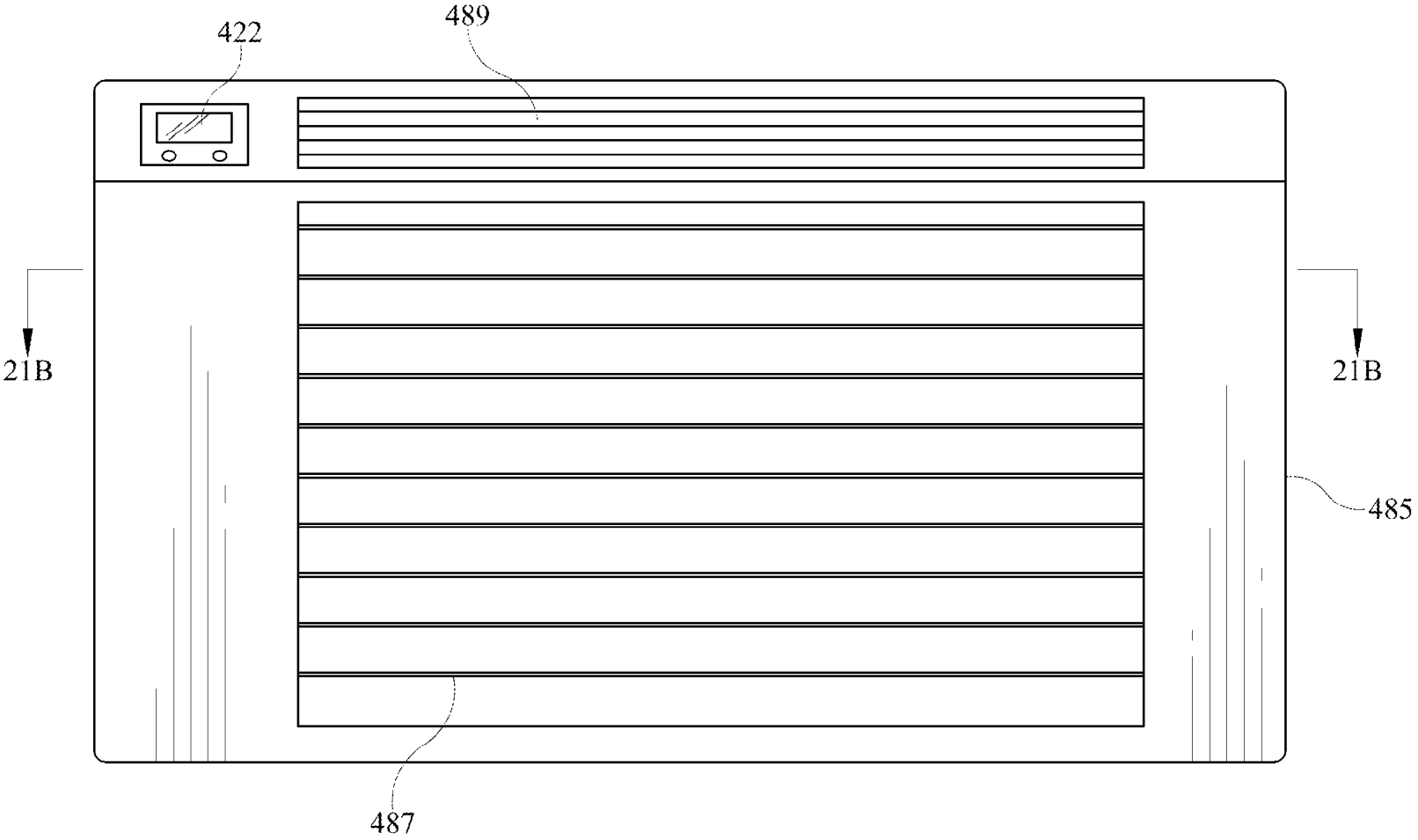
FIG. 21A is a front view of a window fan system that includes air conditioning functionality; the window fan system is shown in a state for providing air conditioning.
Figure 21B:
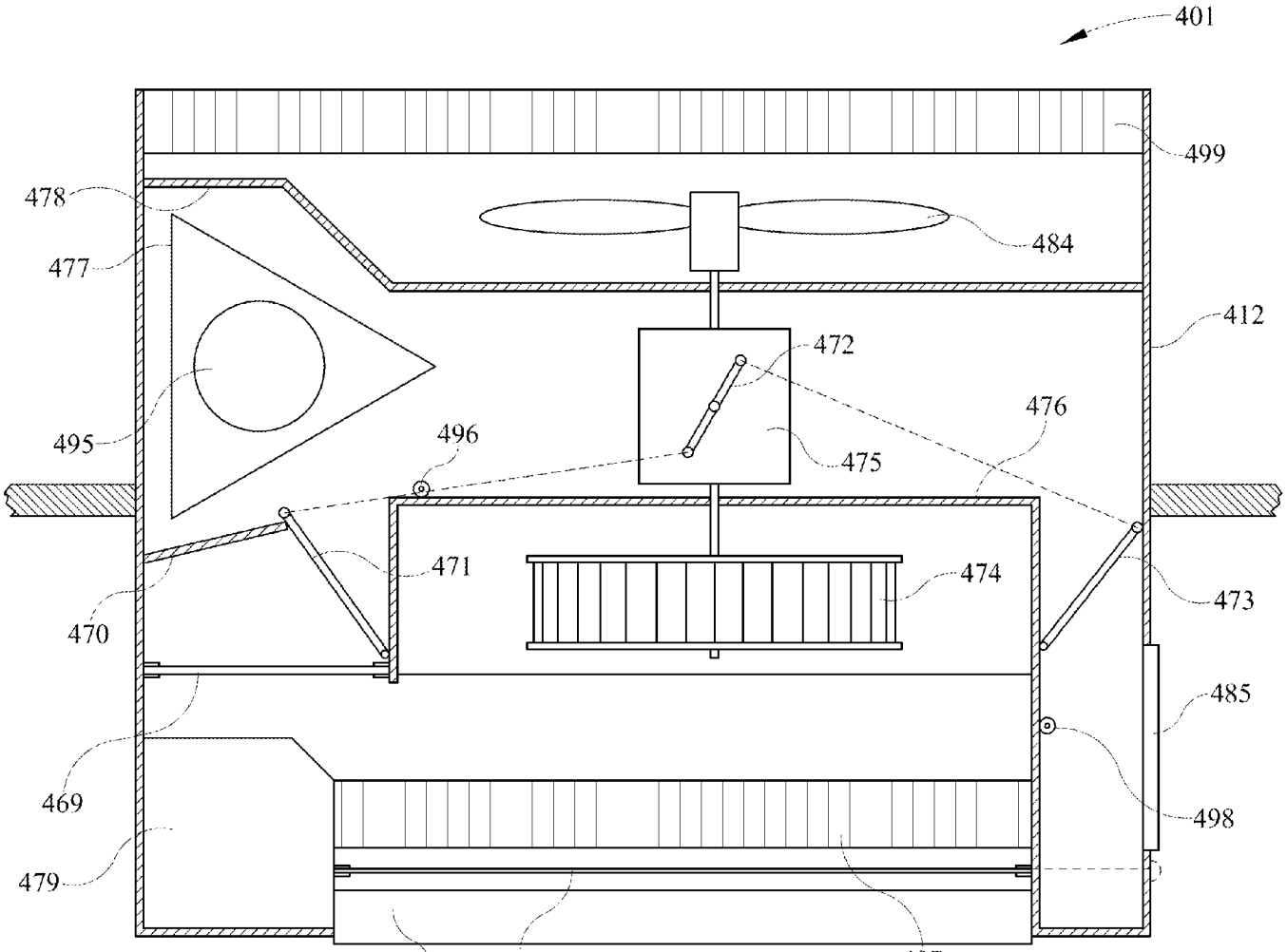
FIG. 21B is a top section view of the window fan system of FIG. 21A taken along the section line 21B-21B of FIG. 21A.

Referring now to FIGS. 21A and 21B, a front view and a top section view, respectively, of a window fan system 401 that includes air conditioning functionality is provided. As described in additional detail herein, the window fan system 401 is in a state for providing air conditioning in FIGS. 21A and 21B. The window fan system 401 includes a housing 412 that may be installed such that it extends between an interior area and an exterior area. A window sill, visible on both sides of the housing 412 in FIG. 21B, generally defines the barrier between the interior area and the exterior area. FIG. 21A provides a front view (from the interior area side) of the window fan unit 410. Actuable front louvers 487 are visible in an open state in FIG. 21A and provide for selective intake of interior air when they are in the open state and the window fan system 401 is in an air conditioning mode. An air discharge 489 is also visible in FIG. 21A and provides for cooled air discharge into the interior area when the window fan system 401 is in the air conditioning mode. A control panel 422 is also visible in FIG. 21A. Control panel 422 may have a similar configuration as control panel 22 and/or control panel 122 and may include one or more indicators and/or displays such as, for example, those shown in FIG. 23.

Inside the housing 412 is a fan motor 475 that is coupled to and drives a blower or indoor fan 474 and also drives an outdoor fan 484. In FIG. 21B the indoor fan 474 is substantially isolated from exterior air by panel 476, panel 470, closed actuable intake barrier or door 471 and closed actuable exhaust barrier or door 473. The doors 471 and 473 are actuable in between at least a closed position (FIG. 21B) and an open position (FIG. 22B) and are actuated via a linkage 472 coupled to a motor such as, for example, an actuator motor. The panels 476 and 470 and the intake doors 471 and 473 span from proximal the top to proximal the bottom of the interior of the housing 412 to substantially isolate indoor fan 474 from exterior air. When window fan system 401 is running in the air conditioning mode, indoor fan 474 draws interior air in through the open front louvers 487, through a filter 488, through an evaporator coil 497 (which cools and/or dehumidifies the air), and back into the interior area through air discharge 489. When window fan system 401 is running in the air conditioning mode, compressor 495 is activated and pumps a refrigerant through the evaporator coil 497 and also pumps the refrigerant through a condensing coil 499 located proximal a rear discharge of the window fan system 401. When window fan system 401 is running in the air conditioning mode, the outdoor fan 484 draws exterior air in through one or more fixed louvers provided on the sides and/or top of the exteriorly positioned portion of the window fan system 401. The fixed louvers may be provided, for example, in the sides and/or top of the window fan system at one or more locations between partition 478 and partitions 470 and 476. The exterior air drawn in by the outdoor fan 484 is blown over the condenser coil 499 and discharged back into the exterior area.

The panel 478 is provided proximal the condenser coil 499. The panel 478 has an opening therethrough and, accordingly, does not completely isolate the outdoor fan 484 from the area around the fan motor 475. In some embodiments the opening may be substantially aligned with the fan 484 and may be of a slightly larger diameter than the fan. A base mount 477 is provided below the compressor 495 to support the compressor 495. A control box housing 479 is provided proximal the evaporator coil and may house an electronic controller (e.g., electronic controller 410 of FIG. 23) among other things. An outdoor sensor 496 is positioned so as to be in communication with exterior air and an indoor sensor 498 is positioned so as to be in communication with interior air. The outdoor sensor 496 and indoor sensor 498 may communicate one or more signals to the controller 410 that are indicative of one or more characteristics of exterior air and interior air, respectively.

Figure 22A:
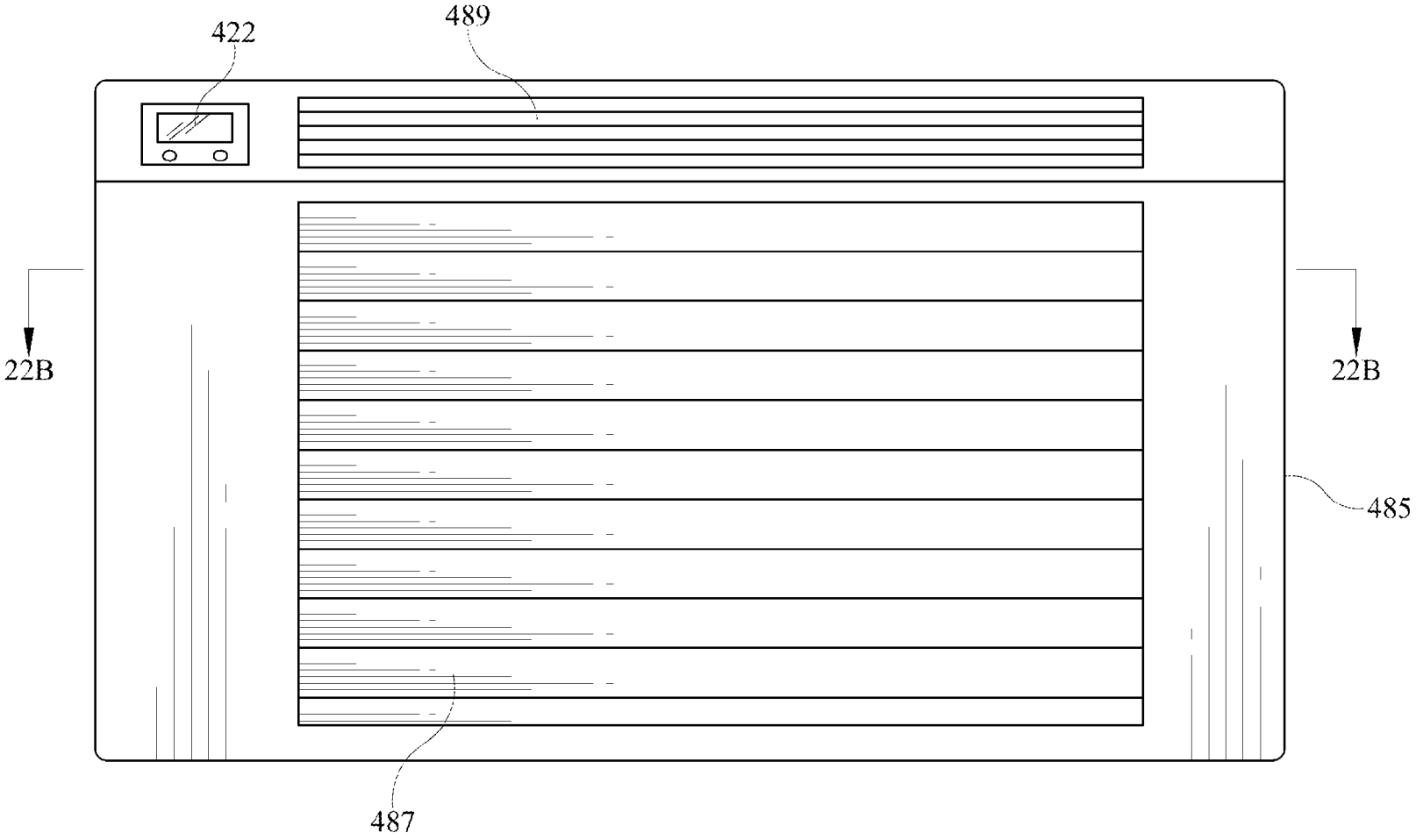
FIG. 22A is a front view of a window fan system that includes air conditioning functionality; the window fan system is shown in a fan only mode.
Figure 22B:
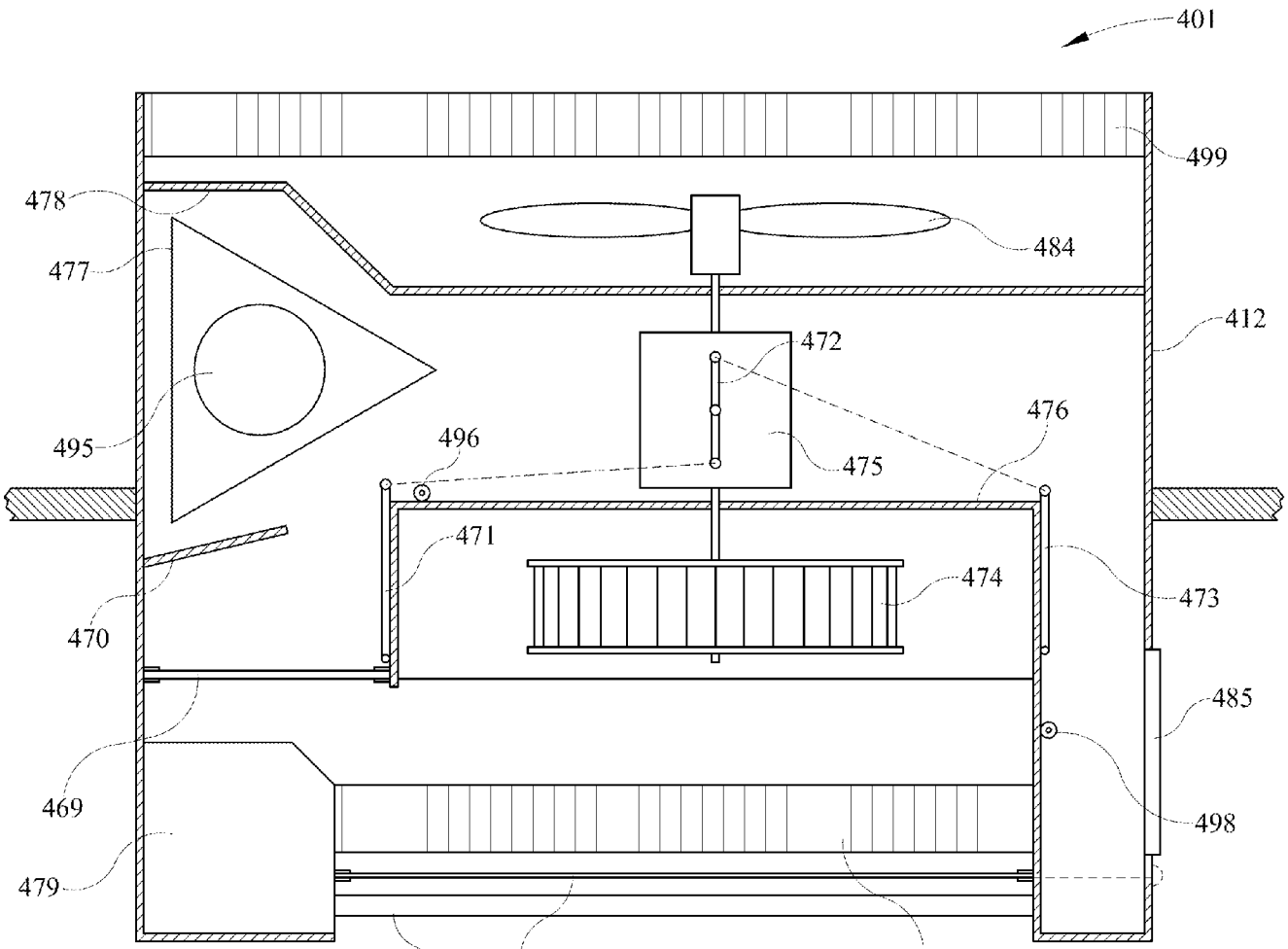
FIG. 22B is a top section view of the window fan system of FIG. 22A taken along the section line 22B-22B of FIG. 22A.

Referring now to FIGS. 22A and 22B, a front view and a top section view, respectively, of the window fan system 401 is provided. As described in additional detail herein, the window fan system 401 is in a non-air conditioning fan only mode in FIGS. 22A and 22B. The actuable louvers 487 are visible in a closed state in FIG. 22A, thereby inhibiting passage of air therethrough. The air discharge 489 will provides discharge of exterior air into the interior area when the window fan system 401 is in the fan only mode. In the fan only mode the intake door 471 and the exhaust door 473 are both in a fully open position. In some embodiments the intake door 471 and/or the exhaust door 473 may only be partially opened in some or all aspects of fan only operations. The intake door 471 and the exhaust door 473 have been moved into the open position through actuation of linkage 472. Indoor fan 474 is no longer isolated from the exterior air. Indoor fan 474 may now draw exterior air in through the fixed louvers provided on the exteriorly positioned portion of the window fan system 401, through the opening that is created by intake door 471 being in the open position, through pollen filter 469, and discharge the exterior air through air discharge 489 into the interior area. Also, outdoor fan 484 is no longer isolated from the interior air. Outdoor fan 484 may now draw interior air in through a fixed louver 485 provided on the side of the interiorly positioned portion of the window fan system 401, through the opening that is created by the exhaust door 473 being in the open position, and discharge the interior air through condenser coils 499 and into the exterior environment. The compressor 495 is not operated in the fan only mode. When the window fan system 401 is not being operated, the doors 471 and 473 and/or the front louvers 487 may be closed to inhibit air exchange between the interior area and the exterior area. It is understood that the doors 471 and 473 may be closed, that the front louvers 487 may be opened, and the compressor 495 may be deactivated if a user (or the controller 410) desires to have fan operation without air conditioning functionality and without drawing in exterior air and/or expelling interior air.

Figure 23:
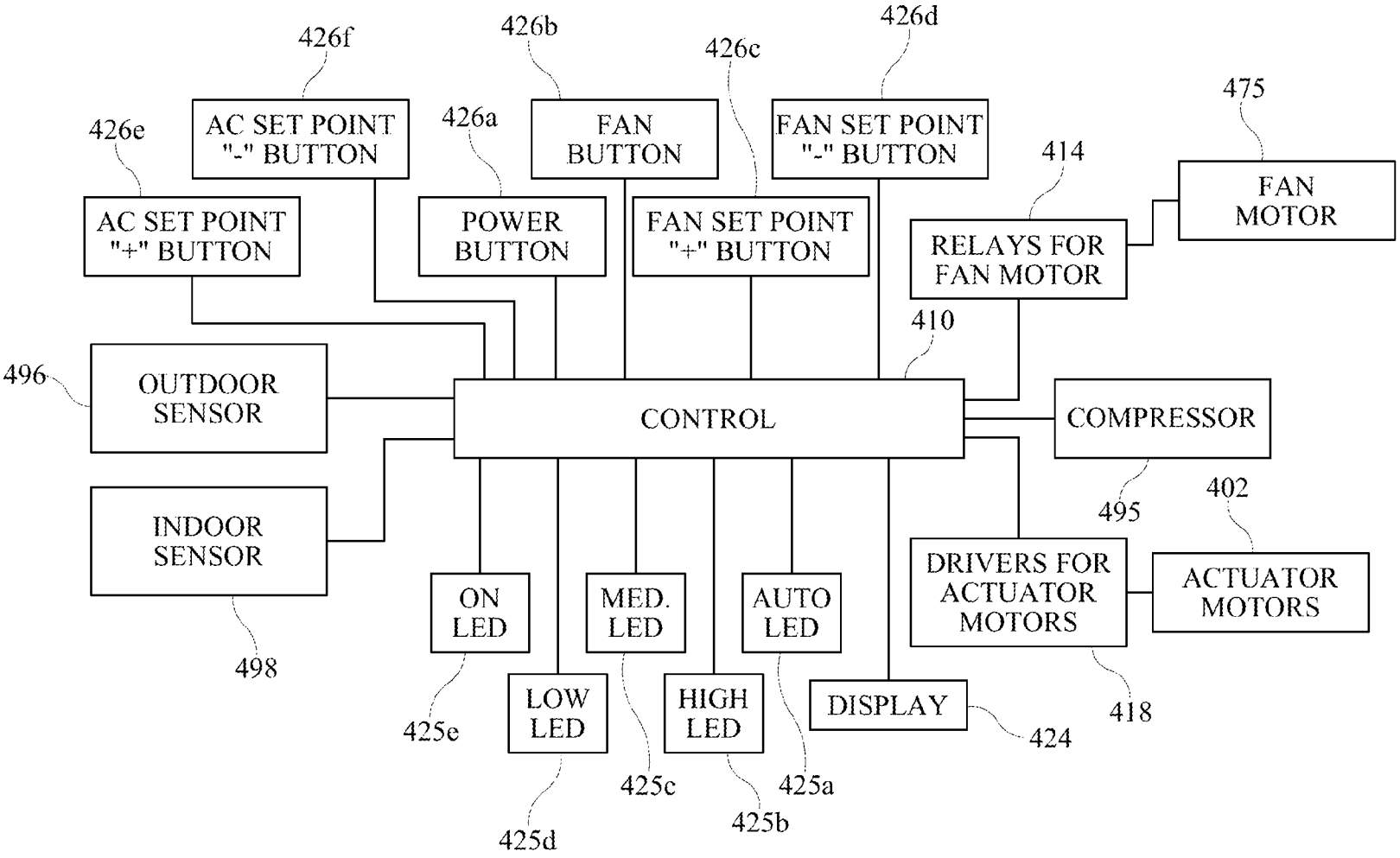
FIG. 23 is a schematic representation of a control system for a window fan system or other system that includes air conditioning functionality.

Referring now to FIG. 23, a schematic representation of an embodiment of a control system for the window fan system 401 or other system that includes air conditioning functionality is provided. The control system of FIG. 23 has many elements in common with the control system of FIG. 17 and, except as otherwise described herein, like numbering between the two refers to similar parts with similar functionality. Accordingly, description concerning many aspects of the control system of FIG. 22 is omitted herein for purpose of conciseness. However, it is understood that those aspects of the control system of FIG. 22 having numbering of 4XX share a substantially common configuration with those aspects of the control system of FIG. 17 having numbering of XX or 1XX. For example, power button 426*a* has a common configuration as power button 126*a*. Moreover, as described above with respect to FIG. 17, the controller 410 and/or other components of the control system may be located remote from other components of the control system. For example, where a virtual control interface is provided the virtual control interface may be rendered on a computing device of a user, and the controller 410 may be housed in a window fan system or in a control panel of a central air condition system or central ducted system.

The fan set point "+" button 426*c* and fan set point "–" button 426*d* are in communication with controller 410 and are provided to enable a user to increment the fan only non-AC set point upwardly or downwardly, respectively. A separate AC set point "+" button 426*e* and AC set point "–" button 426*f* are in communication with controller 410 and are provided to enable a user to increment the AC set point upwardly or downwardly, respectively. In some embodiments a user may select both an AC set point and a fan only set point. In some embodiments a user may select an AC set point or a fan only set point and then may choose a desired temperature differential for the other of the AC set point and the fan only set point (e.g., a five degree temperature differential). In other embodiments the user may only enter in one of the AC set point and the fan only set point and the controller 410 may automatically determine the other of the AC set point and the fan only set point.

The controller 410 is also in communication with the compressor 495. A relay, driver, and/or a motor may optionally be interposed between controller 410 and compressor 495. The controller 410 causes the compressor 495 to be activated when AC functionality is desired. The controller 410 also is in communication with drivers 418 for actuator motors. The drivers 418 are in electrical communication with actuator motors 402 and may be selectively activated to accurately control one or more actuator motors 402. The one or more actuator motors 402 may control, inter alia, movable louver 487 and linkage 472. The controller 410 selectively causes drivers 418 to cause selective of the actuator motors 402 to appropriately actuate one or more barriers (e.g., louvers and/or doors). For example, when fan only operation is desired the controller 410 may cause drivers 418 to cause selective of the actuator motors 402 to close front lovers 487 and open doors 471 and 473. The controller 410 causes fan motor 475 to be driven by fan motors 414 when fan only operation is desired and when AC operation is desired.

Figure 24:
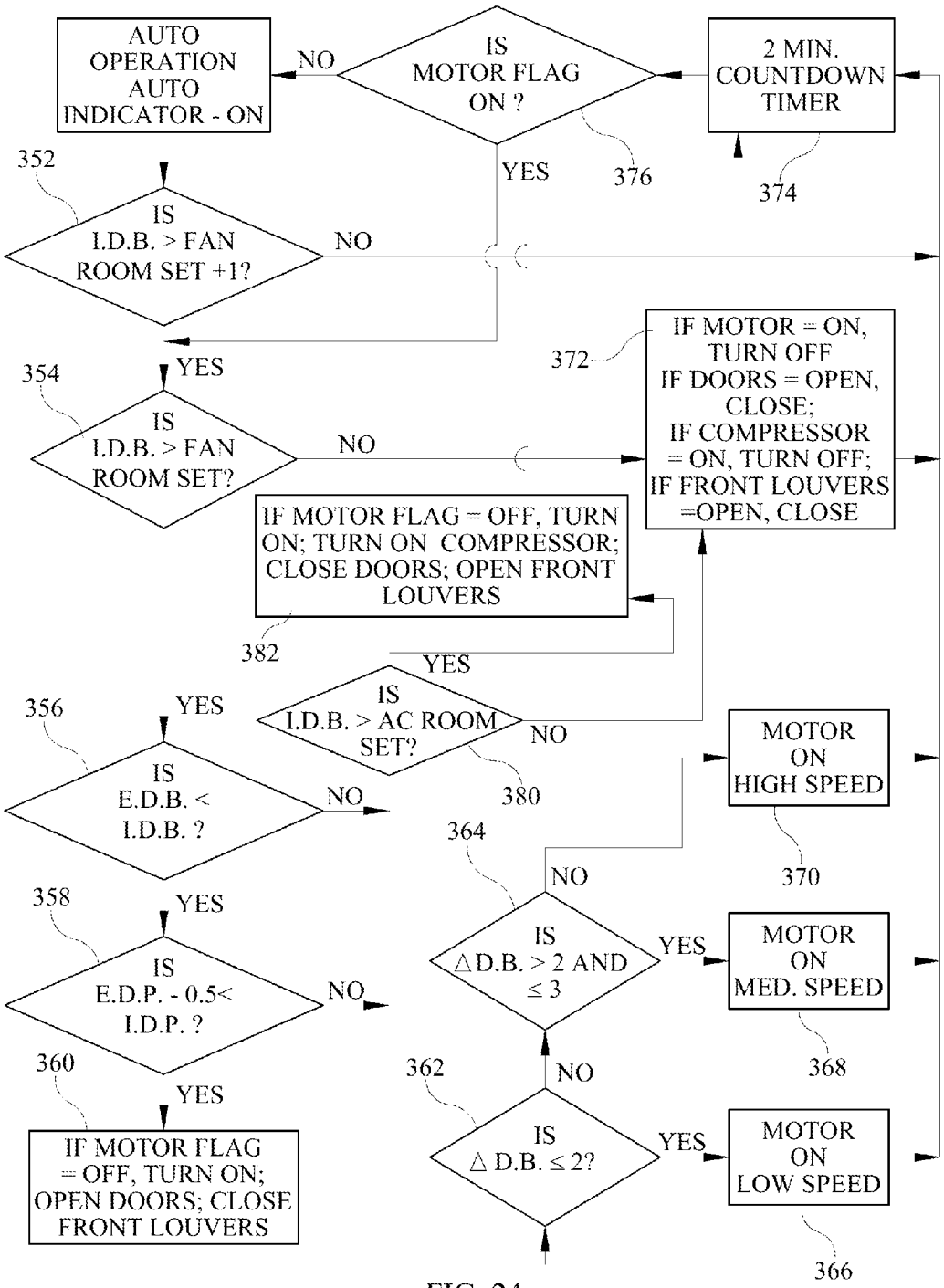
FIG. 24 is a flow diagram of an embodiment of the generalized logic of a controller when automatically operating a window fan system or other system that includes air conditioning functionality.

FIG. 24 is a flow diagram of an embodiment of the generalized logic of a control when automatically operating the window fan system 401 or other system that includes air conditioning functionality. The flow diagram of FIG. 24 has many elements in common with the flow diagram of FIG. 20 and like numbering between the two refers to similar steps with similar functionality. At step 352 the controller 410 determines if the interior dry bulb temperature as indicated by an indoor sensor is greater than the current fan set point temperature plus one degree. If at step 352 the interior dry bulb temperature is determined to be greater than the current set point temperature plus one degree, at step 354 controller 410 determines if the interior dry bulb temperature is greater than the current fan set point. If the interior dry bulb temperature is greater than the current fan set point, at step 356 controller 410 determines if the exterior dry bulb temperature is less than the interior dry bulb temperature. If the exterior dry bulb temperature is less than the interior dry bulb temperature, at step 358 controller 310 determines if the exterior dew point minus five tenths is less than the interior dew point. If so, at step 360 then the controller 410 turns the motor flag on, opens doors 471 and 473, and closes front louvers 487.

The controller 410 then determines at step 362 if the difference between the interior dry bulb temperature and the current fan set point temperature (ΔD.B.) is less than or equal to two. If so, at step 366 the controller 410 activates the necessary relays to drive the fan motor 475 at low speed. If the difference between the interior dry bulb temperature and the current fan set point temperature is not less than or equal to two, the controller 410 determines at step 364 if the difference between the interior dry bulb temperature and the current fan set point temperature is greater than two and less than or equal to three. If so, at step 368 the controller 410 activates the necessary relays to drive the fan motor 475 at medium speed. If the difference between the interior dry bulb temperature and the current fan set point temperature is not greater than two and less than or equal to three, then at step 370 the controller 410 activates the necessary relays to drive the fan motor 475 at high speed. One of ordinary skill in the art having had the benefit of the present disclosure will recognize that more or fewer than three fan speeds corresponding to more or fewer temperature differentials may be provided. For example, in some embodiments one or more fans may be driven at five preselected speeds corresponding to five different temperature differential ranges. Moreover, motor speed may optionally be continuously variable between a maximum and a minimum speed and may be driven at a desired speed based on, inter alia, a temperature range or a specific temperature differential.

Once the controller 410 has activated the necessary controls to drive the fan motor 475 at an appropriate speed, a two minute countdown timer is started in step 374. After the two minute timer is completed the controller 410 checks to see if the motor flag is on in step 376. If the motor flag is on then controller 410 will proceed to determine if the conditions of steps 354, 356, and 358 continue to be met. If the condition of step 354 is not met, motor flag will be turned off if it is on, fan motor 475 will also be turned off, and then the two minute timer of step 374 executed. Following execution of the two minute timer, the process will proceed to step 352 (since the motor flag is no longer on) to determine if the indoor dry bulb temperature is greater than the current set point temperature plus one degree.

If during automatic operation the condition at step 354 is met, but either of the conditions at steps 356 and steps 358 is not met, then the controller 410 at step 380 checks to see if the interior dry bulb temperature is greater than the AC room set point. If the interior dry bulb temperature is not greater than the current AC room set point then the controller 410 progresses to step 372. If, however, the interior dry bulb temperature is greater than the current AC room set point then the controller progresses to step 382. At step 382 the controller 410 turns the motor flag on if it is off, turns on the compressor 495, closes doors 471 and 473, and opens front louvers 487, thereby running the fan unit in AC mode. The controller then proceeds to step 374, where a two minute countdown timer is initiated. After the two minute timer is completed the controller 410 checks to see if the motor flag is on in step 376. If the motor flag is on then controller 410 will proceed to determine if the condition of steps 354 has been met and will then continue through the algorithm as previously described herein. While the unit is running in AC mode the speed of the motor 475 may optionally be proportional to the temperature differential between the AC room set point and the interior dry bulb temperature.

Automatic operation of the window fan system 401 will continue until a user chooses a different setting (e.g., manual AC mode or manual fan only mode) or powers the window fan system down. Automatic operation of the window fan system 401 brings exterior air into an interior area and exhausts interior air to an exterior area when doing so would be advantageous in cooling the interior area as desired by a user. Moreover, automatic operation of the window fan system 401 enables use of a compressor to cool interior air to prevent the interior air from heating beyond a user selected maximum level. Automatic operation of the window fan system 401 may result in energy savings without requiring consistent monitoring by a user and without the need to sync the window fan system 401 with a separate air conditioner or other device.

Figure 25:
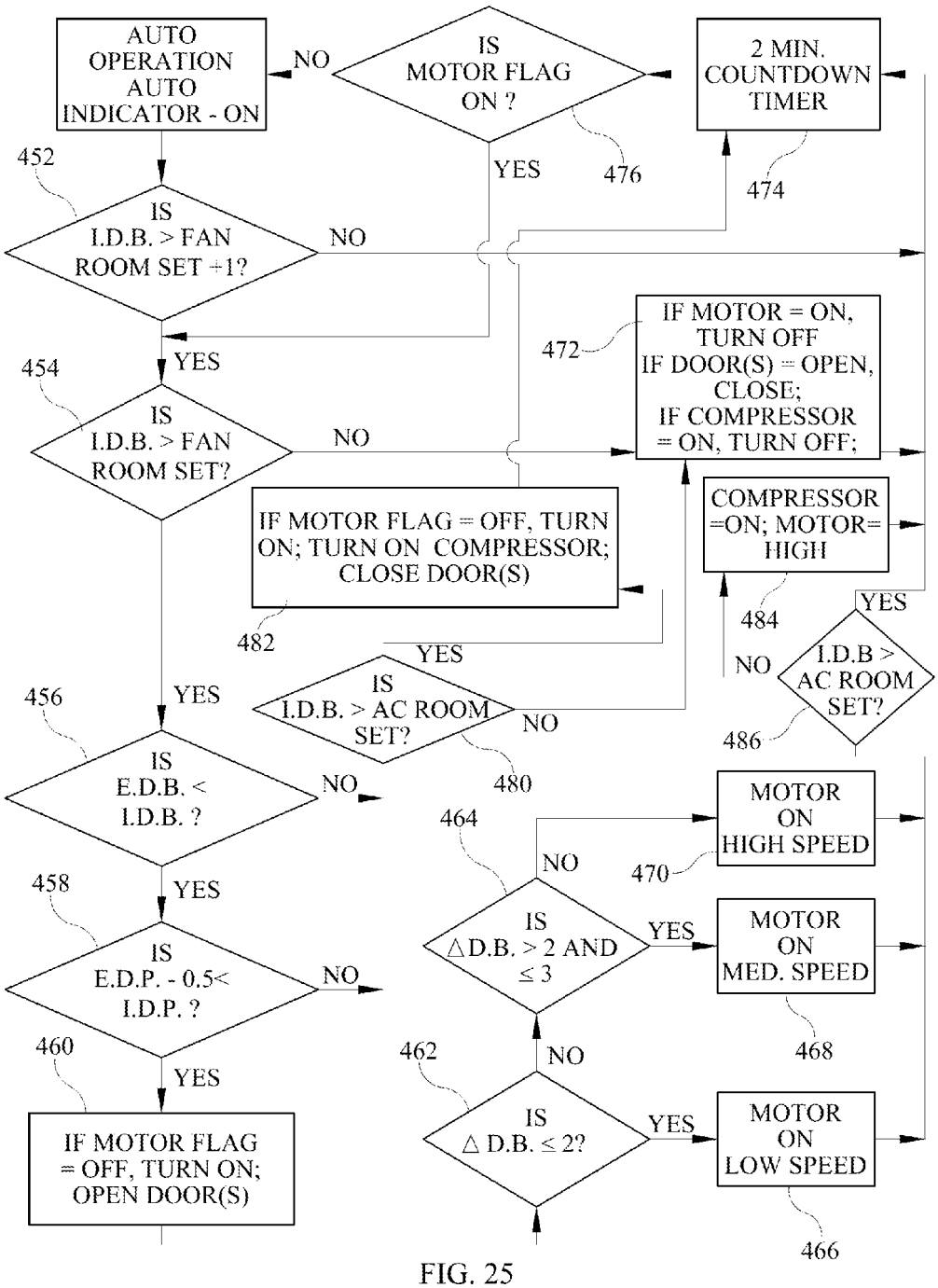
FIG. 25 is a flow diagram of another embodiment of the generalized logic of a controller when automatically operating a window fan system or other system that includes air conditioning functionality

FIG. 25 is a flow diagram of another embodiment of the generalized logic of a control when automatically operating the window fan system 401 or other system that includes air conditioning functionality. The flow diagram of FIG. 25 has many elements in common with the flow diagram of FIG. 24 and like numbering between the two refers to similar steps with similar functionality. At step 452 the controller 410 determines if the interior dry bulb temperature as indicated by an indoor sensor is greater than the current fan set point temperature plus one degree. If at step 452 the interior dry bulb temperature is determined to be greater than the current set point temperature plus one degree, at step 454 controller 410 determines if the interior dry bulb temperature is greater than the current fan set point. If the interior dry bulb temperature is greater than the current fan set point, at step 456 controller 410 determines if the exterior dry bulb temperature is less than the interior dry bulb temperature. If the exterior dry bulb temperature is less than the interior dry bulb temperature, at step 458 controller 410 determines if the exterior dew point minus five tenths is less than the interior dew point. If so, at step 460 then the controller 410 turns the motor flag on and opens doors 471 and 473.

The controller 410 then determines at step 462 if the difference between the interior dry bulb temperature and the current fan set point temperature (ΔD.B.) is less than or equal to two. If so, at step 466 the controller 410 activates the necessary relays to drive the fan motor 475 at low speed. If the difference between the interior dry bulb temperature and the current fan set point temperature is not less than or equal to two, the controller 410 determines at step 464 if the difference between the interior dry bulb temperature and the current fan set point temperature is greater than two and less than or equal to three. If so, at step 468 the controller 410 activates the necessary relays to drive the fan motor 475 at medium speed. If the difference between the interior dry bulb temperature and the current fan set point temperature is not greater than two and less than or equal to three, then at step 470 the controller 410 activates the necessary relays to drive the fan motor 475 at high speed. One of ordinary skill in the art having had the benefit of the present disclosure will recognize that more or fewer than three fan speeds corresponding to more or fewer temperature differentials may be provided. Moreover, motor speed may optionally be continuously variable between a maximum and a minimum speed and may be driven at a desired speed based on, inter alia, a temperature range or a specific temperature differential.

At step 486, the controller 410 determines if the interior dry bulb temperature is greater than the AC room set point. If the interior dry bulb temperature is not greater than the current AC room set point then the controller 410 progresses to step 474 where a two minute countdown timer is started. If, however, the interior dry bulb temperature is greater than the current AC room set point then the controller progresses to step 484. At step 484 the controller 410 turns on the compressor 495 and optionally sets the speed of the fan motor 475 to high. The controller 410 then progresses to step 474 where a two minute countdown timer is started.

It is noted that at step 484 the compressor 495 will be on and the door(s) or other barrier(s) will also be open (as a result of step 460). Accordingly, the compressor 495 is on and exterior air is being brought in via the opening of the barriers. This enables exterior air to be brought in and further cooled by the compressor 495 when the exterior air meets certain criteria and when the interior dry bulb temperature is greater than the AC room set point. This may occur, for example, when there is a high interior or solar load and bringing in exterior air without simultaneous activation of the compressor in one or more previous iterations of the logic of FIG. 24 was insufficient to cool the interior dry bulb temperature to at or below the AC room set point.

After the two minute timer is completed at step 474, the controller 410 checks to see if the motor flag is on in step 476. If the motor flag is on then controller 410 will proceed to determine if the conditions of steps 454, 456, and 458 continue to be met. If the condition of step 454 is not met, motor flag will be turned off if it is on, fan motor 475 will also be turned off, and then the two minute timer of step 474 executed. Following execution of the two minute timer, the process will proceed to step 452 (since the motor flag is no longer on) to determine if the indoor dry bulb temperature is greater than the current set point temperature plus one degree.

If during automatic operation the condition at step 454 is met, but either of the conditions at steps 456 and steps 458 is not met, then the controller 410 at step 480 checks to see if the interior dry bulb temperature is greater than the AC room set point. If the interior dry bulb temperature is not greater than the current AC room set point then the controller 410 progresses to step 472. If, however, the interior dry bulb temperature is greater than the current AC room set point then the controller progresses to step 482. At step 482 the controller 410 turns the motor flag on if it is off, turns on the compressor 495, and closes doors 471 and 473, thereby running the fan unit in AC mode without bringing in exterior air via opening of the door(s) or other barrier(s). The controller then proceeds to step 474, where a two minute countdown timer is initiated. After the two minute timer is completed the controller 410 checks to see if the motor flag is on in step 476. If the motor flag is on then controller 410 will proceed to determine if the condition of steps 454 has been met and will then continue through the algorithm as previously described herein.

In some embodiments, the operation of a system with a fan and a compressor in a mode according to some embodiments of FIG. 25 may be summarized as follows. If the exterior air meets certain criteria and the interior air dry bulb temperature is above the fan room set point and below the AC room set point, then exterior air is brought in without simultaneous activation of the compressor. If the exterior air meets the certain criteria and the interior air dry bulb temperature is above the AC room set point, then exterior air is brought in with simultaneous activation of the compressor. If the exterior air does not meet the certain criteria and the interior air dry bulb temperature is above the room set point and below the AC room set point, then exterior air is not brought in and the compressor is not activated. If the exterior air does not meet the certain criteria and the interior air dry bulb temperature is above the AC room set point, then the compressor is activated without simultaneously bringing in exterior air (e.g., the interior air will be circulated over an evaporator coupled to the compressor).

As with other embodiments described herein, the logic of FIG. 25 may be implemented in conjunction with a window fan unit installable in a window or other opening and/or implemented in conjunction with a central air conditioning system or central ducted system. In embodiments where the logic of FIG. 25 is implemented in conjunction with a window fan unit installable in a window or other opening, barrier(s) of the window fan unit and/or an evaporator of the window fan unit may be adapted to enable exterior air to be drawn from the exterior and passed over the evaporator when certain criteria are met (e.g., when the criteria of steps 456, 458, and 460 are met).

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A control system comprising:

an electronic controller in communication with one or more fans and with a compressor;

wherein at least one fan of the fans selectively draws air from an exterior area having exterior air into an interior area having interior air, and wherein the compressor helps selectively cool air circulated by at least one of the fans;

a control interface having a user selectable non-AC set point input and a separate user selectable AC set point input, the control interface in communication with the electronic controller and providing a user selected non-AC set point and a user selected AC set point to the controller, wherein the user selected AC set point indicates a higher dry bulb temperature than the user selected non-AC set point, and wherein the user selected non-AC set point is based on user interaction with the non-AC set point input and the user selected AC set point is based on user interaction with the AC set point input;

an indoor sensor located to be responsive to at least two characteristics of the interior air, the indoor sensor in communication with the electronic controller and communicating, to the electronic controller, indoor air data that is indicative of the two characteristics of the interior air;

an outdoor sensor located to be responsive to at least two characteristics of the exterior air, the outdoor sensor in communication with the electronic controller and communicating, to the electronic controller, exterior air data indicative of the two characteristics of the exterior air;

wherein the electronic controller is operable in at least a first mode, wherein in the first mode the electronic controller causes, in conjunction with the compressor being inactive, the intake fan to be activated and exterior air to be communicated from the exterior area into the interior area when:

the interior air data indicates a dry bulb temperature of the interior air is greater than the non-AC set point, the exterior air data indicates a dry bulb temperature of the exterior air is less than the dry bulb temperature of the interior air, and the exterior air data indicates a dew point of the exterior air is less than a dew point of the interior air;

wherein in the first mode the electronic controller further causes the compressor to be active and cool the interior air circulated by at least one of the fans when the interior air data indicates a dry bulb temperature of the interior air is greater than the AC set point and at least one of the following two conditions is met:

the exterior air data indicates a dry bulb temperature of the exterior air is greater than the dry bulb temperature of the interior air indicated by the interior air data, and the exterior air data indicates a dew point of the exterior air is greater than a dew point of the interior air indicated by the interior air data.

2. The control system of claim 1, wherein the fans further include an exhaust fan that selectively expels the interior air into the exterior area.

3. The control system of claim 2, wherein in the first mode the electronic controller causes the exhaust fan to be active during at least a portion of the time that the compressor is inactive, the fan is activated and exterior air is being communicated from the exterior area into the interior area.

4. The control system of claim 1, wherein the fan is driveable at a plurality of speeds and wherein the electronic controller determines a speed of the plurality of speeds based on a differential between the non-AC set point and the indoor dry bulb temperature when the electronic controller causes the intake fan to be activated and exterior air to be communicated from the exterior area into the interior area in the first mode.

5. The control system of claim 1, wherein the electronic controller causes at least one barrier to be opened when the controller causes the fan to be activated and exterior air to be communicated from the exterior area into the interior area in the first mode; and wherein the barrier is closed during at least a portion of the time when the compressor is activated in the first mode.

6. The control system of claim 5, wherein when the barrier is closed the fan is isolated from the exterior air and the fan circulates the interior air over an evaporator coil and back into the interior area.

7. The control system of claim 6, wherein the fans further include an exhaust fan that selectively expels the interior air into the exterior area, and when the barrier is closed the exhaust fan selectively circulates the exterior air over a condensing coil and into the exterior area.

8. The control system of claim 7, wherein the exhaust fan expels the interior air into the exterior area when:

the interior air data indicates a dry bulb temperature of the interior air is greater than the non-AC set point, the exterior air data indicates a dry bulb temperature of the exterior air is less than the dry bulb temperature of the interior air, and the exterior air data indicates a dew point of the exterior air is less than a dew point of the interior air.

9. The control system of claim 1, wherein the fan and the compressor are housed in a window fan unit installable in a window.

10. The control system of claim 1, wherein in the first mode the compressor is only active when:

the interior air data indicates the dry bulb temperature of the interior air is greater than the AC set point and at least one of the following two conditions is met:

the exterior air data indicates a dry bulb temperature of the exterior air is greater than the dry bulb temperature of the interior air indicated by the interior air data, and the exterior air data indicates a dew point of the exterior air is greater than a dew point of the interior air indicated by the interior air data.

11. The control system of claim 1, wherein in the first mode the electronic controller causes the intake fan to be activated and the compressor to be activated to cool exterior air pulled in by the intake fan when:

the interior air data indicates a dry bulb temperature of the interior air is greater than the AC set point, the exterior air data indicates a dry bulb temperature of the exterior air is less than the dry bulb temperature of the interior air, and the exterior air data indicates a dew point of the exterior air is less than a dew point of the interior air.

12. A method, comprising:

receiving, in response to user interaction with a control interface, a user selected non-AC set point and a user selected AC set point, the user selected AC set point indicating a higher dry bulb temperature than the user selected non-AC set point input;

receiving, from an indoor sensor, indoor sensor data that is indicative of at least two characteristics of interior air of an interior area;

receiving outdoor sensor data that is indicative of at least two characteristics of exterior air of an exterior area;

determining satisfaction of a first set of conditions, the first set of conditions including:

that the interior air data indicates a dry bulb temperature of the interior air is greater than the non-AC set point, that the exterior air data indicates a dry bulb temperature of the exterior air is less than the dry bulb temperature of the interior air, and that the exterior air data indicates a dew point of the exterior air is less than a dew point of the interior air;

in response to determining the satisfaction of the first set of conditions, activating a fan to draw exterior air into the interior area without activating a compressor;

determining satisfaction of a second set of conditions, the second set of conditions including:

that the interior air data indicates a dry bulb temperature of the interior air is greater than the AC set point, and at least one of:

that the exterior air data indicates a dry bulb temperature of the exterior air is greater than the dry bulb temperature of the interior air indicated by the interior air data, and that the exterior air data indicates a dew point of the exterior air is greater than a dew point of the interior air indicated by the interior air data;

in response to determining the satisfaction of the second set of conditions, activating the compressor to cool the interior air as it is circulated over an evaporator coil coupled to the compressor.

13. The method of claim 12, further comprising activating an exhaust fan in response to determining the satisfaction of the first set of conditions, the exhaust fan expelling the interior air into the exterior area when activated.

14. The method of claim 12, wherein the fan is driveable at a plurality of speeds and wherein the method further comprises:

determining a speed of the plurality of speeds based on a differential between the non-AC set point and the indoor dry bulb temperature when the first set of conditions is satisfied;

wherein activating the fan comprises activating the fan to be driven at the speed.

15. The method of claim 12, further comprising:

in response to determining the first set of conditions, opening at least one barrier between the fan and the exterior area.

16. The method of claim 15, wherein the barrier is closed during at least a portion of the time when the compressor is activated in response to determining satisfaction of the second set of conditions.

17. The method of claim 16, wherein when the barrier is closed the fan is isolated from the exterior air and the fan circulates the interior air over the evaporator coil and back into the interior area.

18. The method of claim 12, further comprising:

determining satisfaction of a third set of conditions, the third set of conditions including:

that the interior air data indicates a dry bulb temperature of the interior air is greater than the AC set point, that the exterior air data indicates a dry bulb temperature of the exterior air is less than the dry bulb temperature of the interior air, and that the exterior air data indicates a dew point of the exterior air is less than a dew point of the interior air; and in response to determining the satisfaction of the third set of conditions, activating the fan to draw the exterior air into the interior area, and activating the compressor to cool the exterior air as it is circulated over the evaporator coil coupled to the compressor.

19. A method, comprising:

receiving, in response to user interaction with a control interface, a user selected non-AC set point and a user selected AC set point, the user selected AC set point indicating a higher dry bulb temperature than the user selected non-AC set point input;

receiving, from an indoor sensor, indoor sensor data that is indicative of at least two characteristics of interior air of an interior area;

receiving outdoor sensor data that is indicative of at least two characteristics of exterior air of an exterior area;

determining satisfaction of a first set of conditions, the first set of conditions including:

that the interior air data indicates a dry bulb temperature of the interior air is greater than the non-AC set point, but less than the AC set point, that the exterior air data indicates a dry bulb temperature of the exterior air is less than the dry bulb temperature of the interior air, and that the exterior air data indicates a dew point of the exterior air is less than a dew point of the interior air;

in response to determining the satisfaction of the first set of conditions, ensuring a barrier is open and activating a fan to draw exterior air into the interior area via an opening caused by the barrier being open without activating a compressor;

determining satisfaction of a second set of conditions, the second set of conditions including:

that the interior air data indicates a dry bulb temperature of the interior air is greater than the AC set point, and at least one of:

that the exterior air data indicates a dry bulb temperature of the exterior air is greater than the dry bulb temperature of the interior air indicated by the interior air data, and that the exterior air data indicates a dew point of the exterior air is greater than a dew point of the interior air indicated by the interior air data;

in response to determining the satisfaction of the second set of conditions, ensuring the barrier is closed and activating the compressor to cool the interior air as it is circulated over an evaporator coil coupled to the compressor;

determining satisfaction of a third set of conditions, the third set of conditions including:

that the interior air data indicates a dry bulb temperature of the interior air is greater than the AC set point, that the exterior air data indicates a dry bulb temperature of the exterior air is less than the dry bulb temperature of the interior air, and that the exterior air data indicates a dew point of the exterior air is less than a dew point of the interior air; and in response to determining the satisfaction of the third set of conditions, ensuring the barrier is open and activating the fan to draw the exterior air into the interior area and activating the compressor to cool the exterior air as it is circulated over the evaporator coil coupled to the compressor.

* * * * *